US008202136B2

(12) United States Patent
Dagenais et al.

(10) Patent No.: US 8,202,136 B2
(45) Date of Patent: Jun. 19, 2012

(54) WATERCRAFT WITH STEER-RESPONSIVE REVERSE GATE

(75) Inventors: Dominic Dagenais, Shefford (CA); Renald Plante, Rock Forest (CA); Andre Denis, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 225 days.

(21) Appl. No.: 12/491,368

(22) Filed: Jun. 25, 2009

(65) Prior Publication Data

US 2009/0264029 A1 Oct. 22, 2009

Related U.S. Application Data

(63) Continuation-in-part of application No. 11/961,650, filed on Dec. 20, 2007, now Pat. No. 7,708,609.

(60) Provisional application No. 61/076,201, filed on Jun. 27, 2008, provisional application No. 60/871,698, filed on Dec. 22, 2006.

(51) Int. Cl.
*B63H 11/107* (2006.01)

(52) U.S. Cl. ..... 440/41

(58) Field of Classification Search ..... 440/1, 38–41
See application file for complete search history.

(56) References Cited

U.S. PATENT DOCUMENTS

| | | | |
|---|---|---|---|
| 5,474,007 | A | 12/1995 | Kobayashi |
| 5,494,464 | A | 2/1996 | Kobayashi et al. |
| 5,507,672 | A | 4/1996 | Imaeda |
| 5,752,864 | A | 5/1998 | Jones et al. |
| 5,755,601 | A | 5/1998 | Jones |
| 6,045,418 | A | 4/2000 | Roos |
| 6,113,443 | A | 9/2000 | Eichinger |
| 6,146,219 | A | 11/2000 | Blanchard |
| 6,159,059 | A | 12/2000 | Bernier et al. |
| 6,231,410 | B1 | 5/2001 | Bernier et al. |
| 6,234,100 | B1 | 5/2001 | Fadeley et al. |
| 6,336,833 | B1 | 1/2002 | Rheault et al. |
| 6,401,644 | B2 | 6/2002 | Fadeley et al. |
| 6,405,669 | B2 | 6/2002 | Rheault et al. |
| 6,428,371 | B1 | 8/2002 | Michel et al. |
| 6,453,835 | B2 | 9/2002 | Fadeley et al. |
| 6,520,815 | B2 | 2/2003 | Bernier et al. |
| 6,533,623 | B2 | 3/2003 | Simard et al. |
| 6,547,611 | B1 | 4/2003 | Boroos et al. |
| 6,554,661 | B2 | 4/2003 | Bernier et al. |
| 6,568,969 | B2 | 5/2003 | Bernier et al. |
| 6,634,912 | B2 | 10/2003 | Bernier et al. |

(Continued)

FOREIGN PATENT DOCUMENTS

WO 2008025169 A1 3/2008

*Primary Examiner* — Daniel Venne
(74) *Attorney, Agent, or Firm* — Osler, Hoskin & Harcourt LLP

(57) ABSTRACT

A method of operating a watercraft is disclosed. The watercraft includes an engine, a jet propulsion system operatively connected to the engine, the jet propulsion system includes a reverse gate, and a steering assembly for steering the watercraft. The method comprises: determining if the steering assembly is turned; sensing an operating parameter of the watercraft, the operating parameter being related to a thrust generated by the propulsion system; determining if the operating parameter of the watercraft is within a predetermined range; and moving the reverse gate to a lowered position when the steering assembly is turned and the operating parameter of the watercraft is within the predetermined range. A watercraft capable of performing the method is also disclosed.

17 Claims, 23 Drawing Sheets

U.S. PATENT DOCUMENTS

| | | | | |
|---|---|---|---|---|
| 6,676,462 | B2 | 1/2004 | Yanagihara | |
| 6,722,632 | B2 | 4/2004 | Kenny et al. | |
| 6,743,062 | B1 | 6/2004 | Jones | |
| 6,793,545 | B2 | 9/2004 | Bernier et al. | |
| 6,875,065 | B2 | 4/2005 | Tsuchiya et al. | |
| 6,905,378 | B2 | 6/2005 | Uraki | |
| 7,018,252 | B2 | 3/2006 | Simard et al. | |
| 7,124,703 | B2 | 10/2006 | Richard et al. | |
| 7,163,425 | B2 | 1/2007 | Kamio | |
| 7,195,527 | B2 | 3/2007 | Tani et al. | |
| 7,481,688 | B2 | 1/2009 | Kobayashi | |
| 7,892,053 | B2 * | 2/2011 | St-Pierre et al. | 440/40 |
| 2003/0077954 | A1 | 4/2003 | Fadeley et al. | |
| 2008/0133075 | A1 | 6/2008 | St-Pierre et al. | |
| 2008/0182463 | A1 | 7/2008 | St-Pierre et al. | |
| 2008/0233811 | A1 | 9/2008 | St-Pierre et al. | |

* cited by examiner

WATERCRAFT WITH STEER-RESPONSIVE REVERSE GATE

CROSS-REFERENCE

The present application claims priority to U.S. Provisional Patent Application No. 61/076,201 filed Jun. 27, 2008, and is a continuation-in-part of U.S. patent application Ser. No. 11/961,650 filed Dec. 20, 2007. Through U.S. patent application Ser. No. 11/961,650, the present application claims priority to U.S. Provisional Patent Application No. 60/871,698 filed Dec. 22, 2006. The entirety of these three applications is incorporated herein by reference.

FIELD OF THE INVENTION

The present invention relates to watercraft having a reverse gate that is actuated, under certain conditions, in response to a position of a steering assembly of the watercraft.

BACKGROUND OF THE INVENTION

There exist many different ways to propel watercraft. One way is to use what is known as a jet propulsion system which is powered by an engine of the watercraft. The jet propulsion system typically consists of a jet pump which pressurizes water from the body of water and expels it through a venturi as a jet rearwardly of the watercraft to create thrust. Usually, a steering nozzle is pivotally mounted rearwardly of the venturi. The steering nozzle is operatively connected to a steering assembly of the watercraft which causes the steering nozzle to turn left or right to redirect the jet of water and thereby steer the watercraft.

In watercraft having a jet propulsion system with a steering nozzle, steering of the watercraft can only be achieved when thrust is generated by the jet propulsion system. Therefore, when no or little thrust is generated by the jet propulsion the watercraft cannot be steered even if the steering nozzle is being turned by the steering assembly. Some inexperienced drivers of such watercraft find this inconvenient since when wanting to avoid an unexpected obstacle they may release the throttle operator of the watercraft and attempt to steer the watercraft. As would be understood, since releasing the throttle operator reduces the thrust generated by the jet propulsion system, they are unable to steer and, as a result, are sometimes unable to avoid the obstacle if the drag generated by the hull of the watercraft is insufficient to stop the watercraft on time.

In order to solve this problem, many different systems were created by watercraft manufacturers. In one such system, the position of the steering assembly and the engine speed are sensed. When it is determined that the engine speed is below a speed at which the thrust generated by the jet propulsion system is insufficient to steer the watercraft (because the driver released the throttle operator, for example) and it is determined that the steering assembly is being turned, then the speed of the engine is automatically increased (i.e. without driver intervention) to a level where the thrust generated by the jet propulsion system is sufficient to steer the watercraft.

Although this system is effective to avoid the above-mentioned problem, some drivers may find the effects of this system a bit unsettling because by releasing the throttle operator they expect the watercraft to decelerate, but when combined with steering, the watercraft actually accelerates.

Therefore, there is a need for method of operating a watercraft where the watercraft can be decelerated when the thrust generated by the watercraft is insufficient to steer the watercraft and the steering assembly is turned.

There is also a need for a method of operating a watercraft which allows the watercraft to be steered when the thrust generated by the watercraft is insufficient to steer the watercraft and the steering assembly is turned.

There is also a need for a watercraft operating under one or both of the above-mentioned methods.

SUMMARY OF THE INVENTION

It is an object of the present invention to ameliorate at least some of the inconveniences present in the prior art.

It is also an object of the present invention to provide a method of operating a watercraft where the reverse gate is lowered when it is determined that the steering assembly is being turned and that an operating parameter of the watercraft being related to a thrust generated by the jet propulsion system is within a predetermined range.

It is another object of the present invention to additionally increase the thrust generated by the jet propulsion system once the reverse gate has been lowered as a result of the above-mentioned method.

When lowered, the reverse gate generates drag which helps slow down the watercraft. By increasing the thrust generated by the jet propulsion system once the reverse gate has been lowered, the redirected thrust further increases the deceleration of the watercraft while also permitting the watercraft to be steered.

In one aspect, the invention provides a method of operating a watercraft. The watercraft includes an engine, a jet propulsion system operatively connected to the engine, the jet propulsion system includes a reverse gate, and a steering assembly for steering the watercraft. The method comprises: determining if the steering assembly is turned; sensing an operating parameter of the watercraft, the operating parameter being related to a thrust generated by the propulsion system; determining if the operating parameter of the watercraft is within a predetermined range; and moving the reverse gate to a lowered position when the steering assembly is turned and the operating parameter of the watercraft is within the predetermined range.

In an additional aspect, the method further comprises increasing a thrust produced by the jet propulsion system in order to control directional movement of the watercraft when: the reverse gate is moved to the lowered position, the steering assembly is turned, and the operating parameter of the watercraft is within the predetermined range.

In a further aspect, increasing the thrust produced by the jet propulsion system includes increasing a speed of the engine.

In an additional aspect, the operating parameter is engine speed. The predetermined range is a range of engine speeds. The range of engine speeds includes engine speeds less than a predetermined engine speed.

In a further aspect, the method further comprises determining if a throttle operator of the watercraft is in an idle position. The reverse gate is moved to a lowered position when: the steering assembly is turned, the engine speed is less than the predetermined engine speed, and the throttle operator is in the idle position.

In an additional aspect, the operating parameter is a throttle operator position. The predetermined range is a range of throttle operator positions. The range of throttle operator positions includes throttle operator positions less than a predetermined throttle operator position.

In a further aspect, the operating parameter is a throttle valve position. The predetermined range is a range of throttle valve positions. The range of throttle valve positions includes throttle valve positions less than a predetermined throttle valve position.

In an additional aspect, the operating parameter is a jet pump pressure of the jet propulsion system. The predetermined range is a range of jet pump pressures. The range of jet pump pressures includes jet pump pressures less than a predetermined jet pump pressure.

In a further aspect, the operating parameter is an acceleration of the watercraft. The predetermined range is a range of accelerations. The range of accelerations includes negative accelerations.

In an additional aspect, determining if the steering assembly is turned includes determining if a steering column of the steering assembly has been turned by at least a predetermined angle.

In a further aspect, determining if the steering assembly is turned includes determining if a steering nozzle of the jet propulsion system has been turned by at least a predetermined angle.

In another aspect, the invention provides a watercraft having a hull, a deck disposed on the hull, an engine compartment defined between the hull and the deck, an engine disposed in the engine compartment, a throttle body having a throttle valve operatively connected to the engine, a throttle operator operatively connected to the throttle valve, a steering assembly disposed at least in part on the deck, a jet pump connected to the hull and being operatively connected to the engine, a venturi connected to a rearward end of the jet pump, a steering nozzle rotationally mounted relative to the venturi, and a reverse gate rotationally mounted relative to the venturi about a reverse gate axis. The steering nozzle is operatively connected to the steering assembly and is disposed at least in part rearwardly of the venturi. The reverse gate axis extends generally laterally and horizontally. A steering assembly position sensor is associated with the steering assembly. The steering assembly position sensor senses a position of the steering assembly. An operating parameter sensor is associated with one of the engine, the throttle valve, and the throttle operator. The operating parameter sensor senses an operating parameter of the one of the engine, the throttle valve, and the throttle operator. A reverse gate actuator is operatively connected to the reverse gate. The reverse gate actuator moves the reverse gate to a lowered position when the steering assembly position sensor senses that the steering assembly has been turned by at least a predetermined angle and the operating parameter sensor senses that the operating parameter is within a predetermined range.

In an additional aspect, an engine control unit is operatively connected to the engine. The engine control unit causes a speed of the engine to be increased in order to control directional movement of the watercraft when: the reverse gate is in the lowered position, the steering assembly position sensor senses that the steering assembly has been turned by at least the predetermined angle, and the operating parameter sensor senses that the operating parameter is within the predetermined range.

In a further aspect, the operating parameter sensor senses engine speed. The predetermined range is a range of engine speeds. The range of engine speeds includes engine speeds less than a predetermined engine speed.

In an additional aspect, a throttle operator position sensor is associated with the throttle operator. The throttle operator position sensor senses a position of the throttle operator. The reverse gate actuator moves the reverse gate to a lowered position when: the steering assembly position sensor senses that the steering assembly has been turned by at least the predetermined angle, the operating parameter sensor senses that the operating parameter is within the predetermined range, and the throttle operator position sensor senses that the throttle operator is in an idle position.

In a further aspect, the operating parameter sensor senses a throttle operator position. The predetermined range is a range of throttle operator positions. The range of throttle operator positions includes throttle operator positions less than a predetermined throttle operator position.

In an additional aspect, the operating parameter sensor senses a throttle valve position. The predetermined range is a range of throttle valve positions. The range of throttle valve positions includes throttle valve positions less than a predetermined throttle valve position.

In a further aspect, the steering assembly position sensor senses a position of a steering column of the steering assembly.

In an additional aspect, the steering assembly position sensor senses a position of the steering nozzle.

For purposes of this application, the term "turned" when applied to the steering assembly, the steering column, or the steering nozzle, for example, means that the component that is turned is in a position that would normally (i.e. when thrust is generated by the jet propulsion system) result in the watercraft being steered in a direction other than a straight ahead direction (i.e. left or right). Also, terms related to spatial orientation such as forwardly, rearwardly, left, and right, are as they would normally be understood by a driver of the watercraft sitting thereon in a normal driving position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a personal watercraft and a sport boat. However, it should be understood that other types of watercraft are contemplated.

The general construction of a personal watercraft 10 in accordance with this invention will be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass other known ways and designs. U.S. Pat. No. 7,124,703, issued Oct. 24, 2006, the entirety of which is incorporated herein by reference, describes one such other watercraft design.

Figure 1:
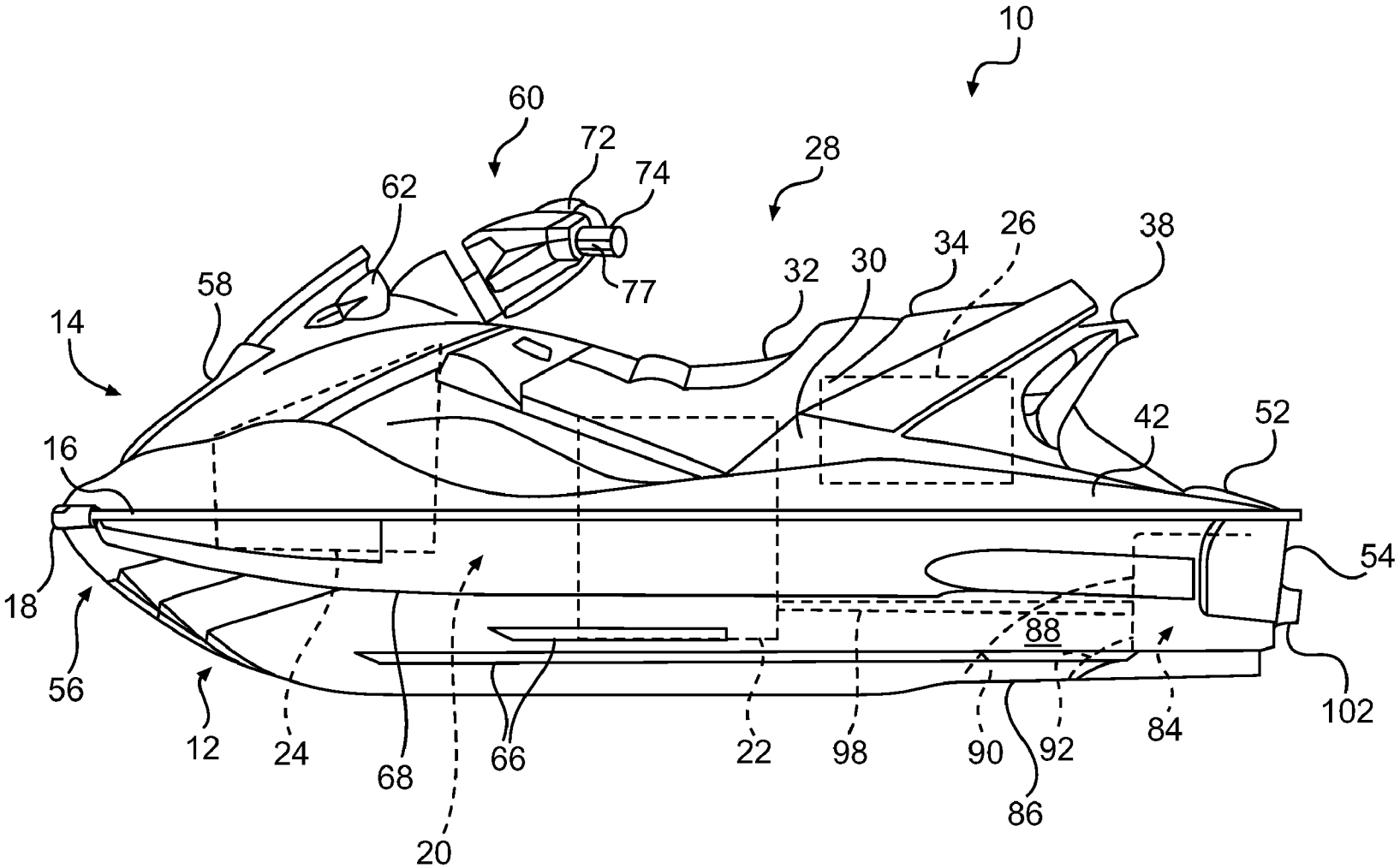
FIG. 1 illustrates a side view of a personal watercraft in accordance with the invention.

The watercraft 10 of FIG. 1 is made of two main parts, including a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or all of the seam 16.

The space between the hull 12 and the deck 14 forms a volume commonly referred to as the engine compartment 20 (shown in phantom). Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the watercraft 10.

Figure 2:
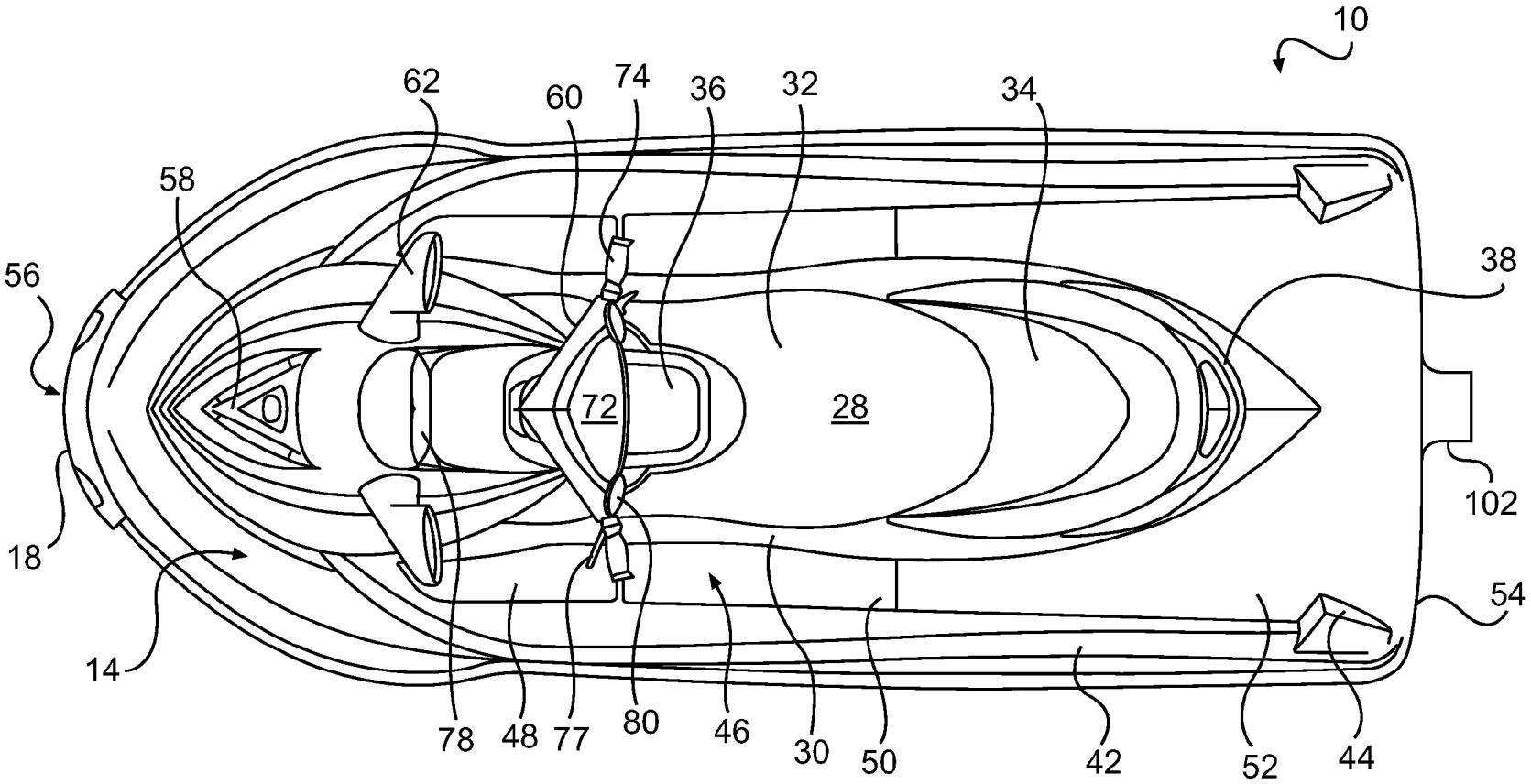
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 is sized to accommodate one or more riders. As seen in FIG. 2, the seat 28 includes a first, front seat portion 32 and a rear, raised seat portion 34 that accommodates a passenger. The seat 28 is preferably made as a cushioned or padded unit or interfitting units. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) covers a removable storage box 26 (FIG. 1). A "glove compartment" or small storage box 36 is provided in front of the seat 28.

Figure 4:
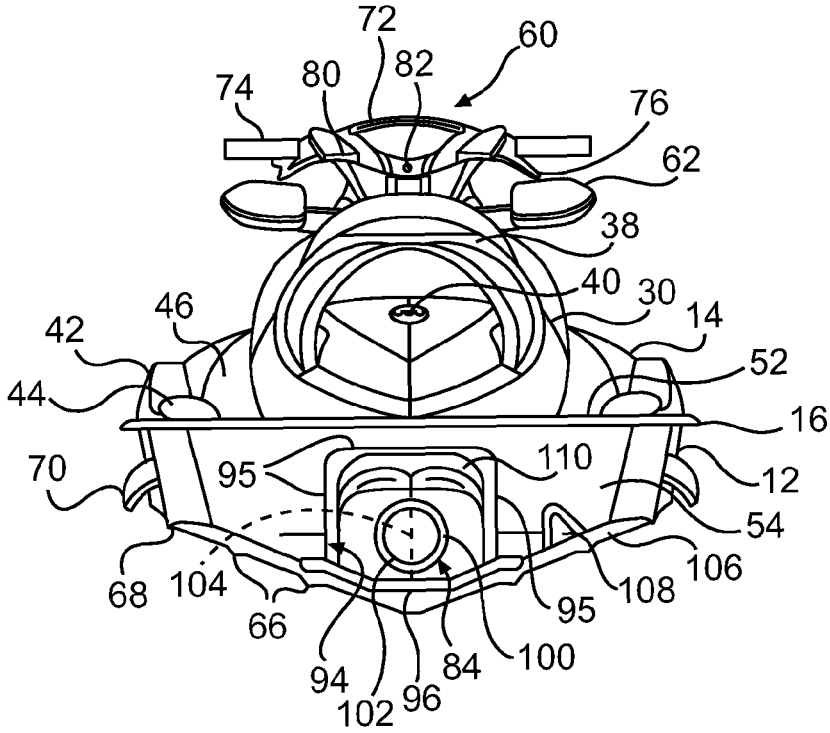
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 are covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
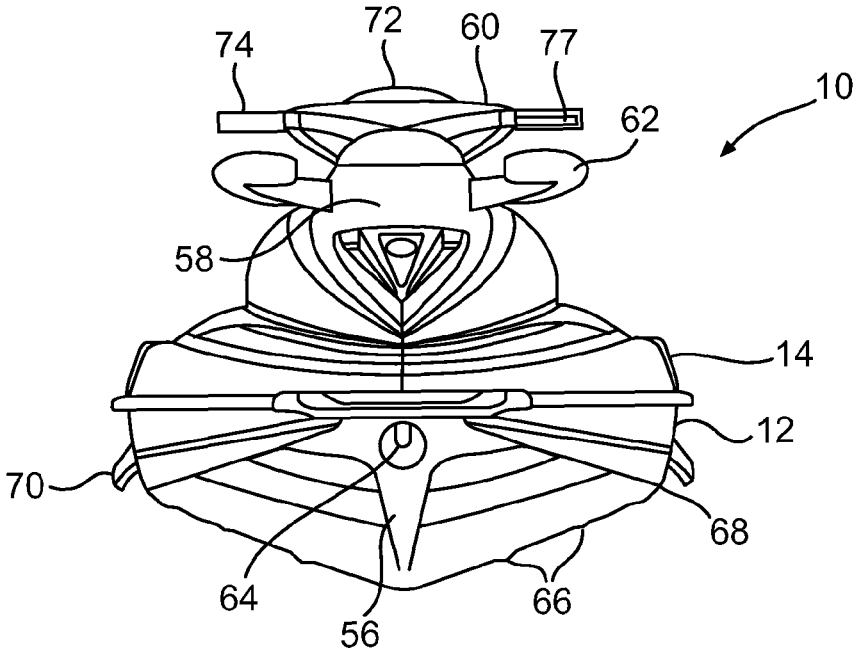
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft is not in use or to attach to a winch when loading the watercraft 10 on a trailer, for instance.

Figure 5:
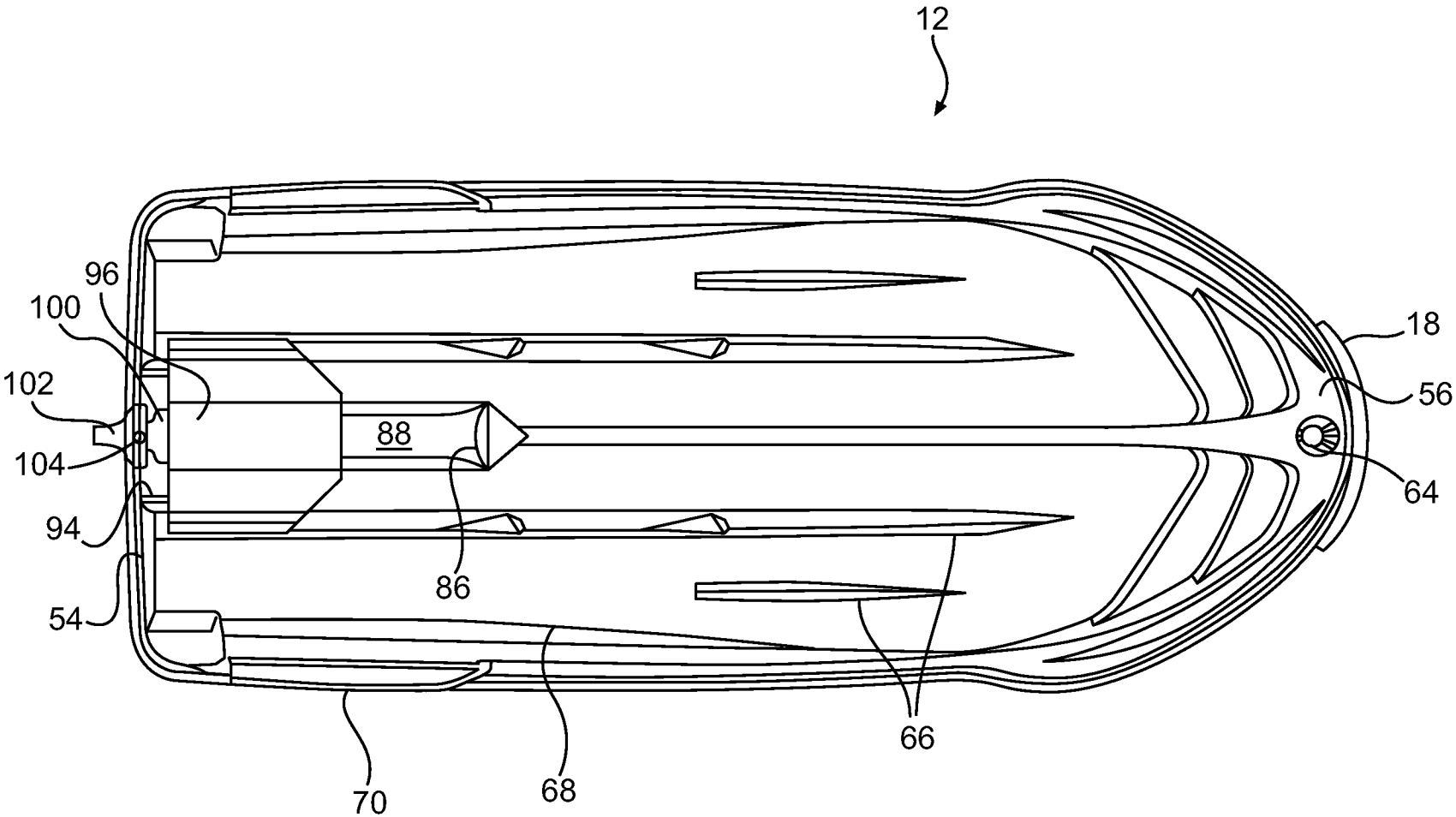
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 preferably have an arcuate undersurface that gives the watercraft 10 both lift while in motion and improved turning characteristics. The sponsons 70 are preferably fixed to the surface of the hull 12 and can be attached to the hull by fasteners or molded therewith. Sometimes it may be desirable to adjust the position of the sponson 70 with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, which may be padded, and a pair of steering handles 74, also referred to as a handlebar. One of the steering handles 74 is preferably provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is preferably biased towards the idle position, such that when the driver of the watercraft lets go of the throttle operator 76, it will move to the idle position. The other of the steering handles 74 may be provided with a lever 77 used by the driver to control the jet propulsion system 84 as described in greater detail below.

As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 has various buttons 80, which could alternatively be in the form of levers or switches that allow the rider to modify the display data or mode (speed, engine rpm, time . . . ) on the display cluster 78. Buttons 80 may also used by the driver to control the jet propulsion system 84 as described in greater detail below.

The helm assembly 60 also has a key receiving post 82, preferably located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. As known, the jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

Figure 8:
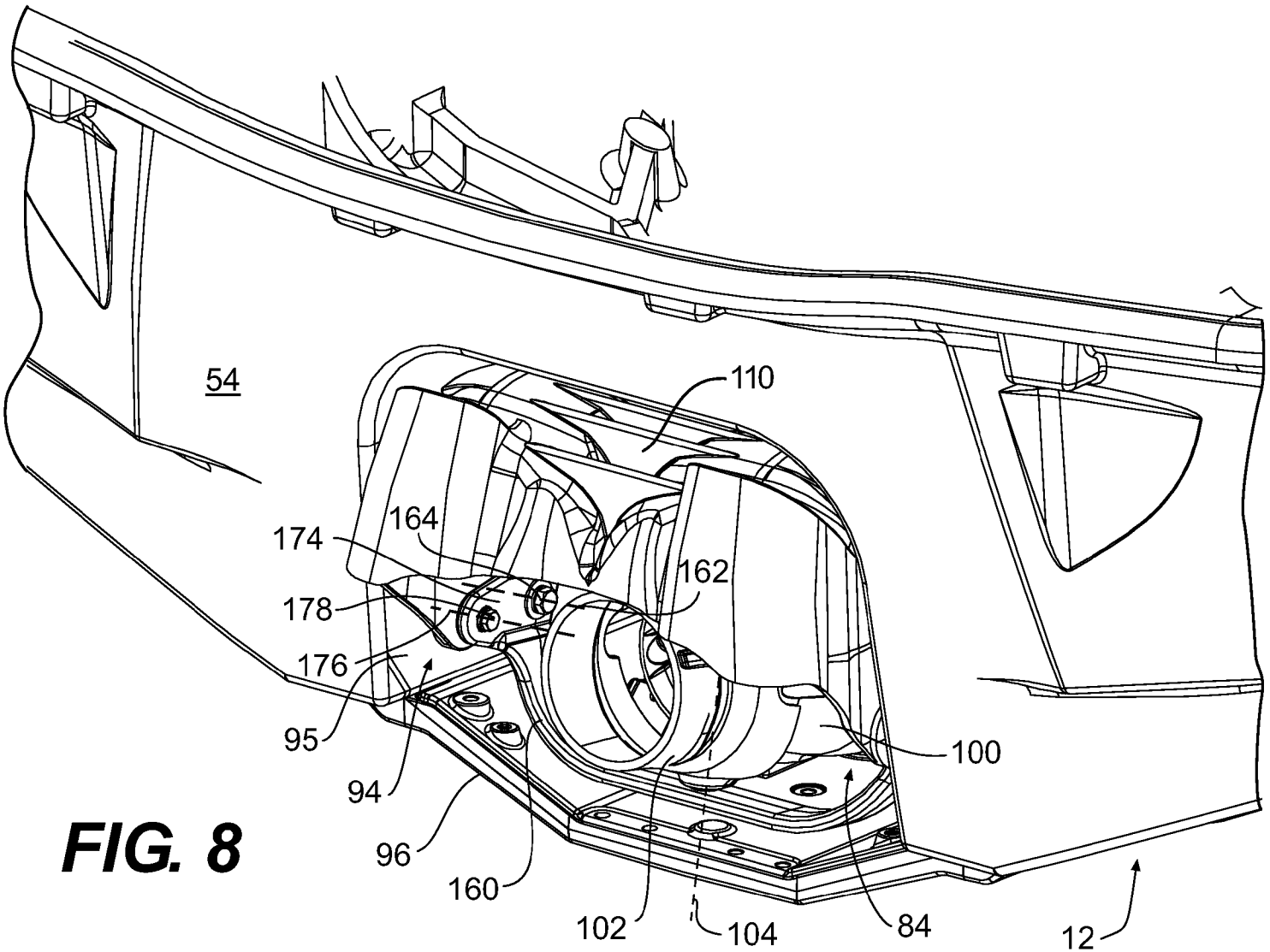
FIG. 8 is a perspective view, taken from a rear, right side, of a transom of the personal watercraft of FIG. 1.

From the intake ramp 88, water enters the jet propulsion system 84. As seen in FIG. 8, the jet propulsion system 84 is located in a formation in the hull 12, referred to as the tunnel 94. The tunnel 94 is defined at the front, sides, and top by walls 95 formed by the hull 12 (see FIG. 9) and is open at the transom 54. The bottom of the tunnel 94 is closed by a ride plate 96. The ride plate 96 creates a surface on which the watercraft 10 rides or planes at high speeds.

The jet propulsion system 84 includes a jet pump 99. The forward end of the jet pump 99 is connected to the front wall 95 of the tunnel 94. The jet pump includes an impeller (not shown) and a stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. Since the venturi's exit diameter is smaller than its entrance diameter, the water is accelerated further, thereby providing more thrust. A steering nozzle 102 is rotationally mounted relative to the venturi 100, as described in greater detail below, so as to pivot about a steering axis 104.

The steering nozzle 102 is operatively connected to the helm assembly 60 preferably via a push-pull cable (not shown) such that when the helm assembly 60 is turned, the steering nozzle 102 pivots about the steering axis 104. This movement redirects the pressurized water coming from the venturi 100, so as to redirect the thrust and steer the watercraft 10 in the desired direction.

The jet propulsion system 84 is provided with a reverse gate 110 which is movable between a stowed position where it does not interfere with a jet of water being expelled by the steering nozzle 102 and a plurality of positions where it redirects the jet of water being expelled by the steering nozzle 102 as described in greater detail below. The reverse gate 110 is provided with flow vents 111 on either sides thereof. When the steering nozzle 110 is in a lowered position and the steering nozzle 102 is turned left or right, a portion of the jet of water being expelled by the steering nozzle 102 flows through a corresponding one of the flow vents 111 thus creating a lateral thrust which assists in steering the watercraft 10. The specific construction of the reverse gate 110 will not be described in detail herein. However it will be understood by those skilled in the art that many different types of reverse gate could be provided without departing from the present invention. One example of a suitable reverse gate is described in U.S. Pat. No. 6,533,623, issued on Mar. 18, 2003, the entirety of which is incorporated herein by reference.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. Alternatively, the vehicle speed sensor 106 could be included in a global positioning system. By using information from the GPS unit, the speed of the watercraft can be determined by calculating a change in position of the watercraft over a period of time which is normally a function of the GPS unit. An electronic control unit (ECU) 228 (FIG. 21) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 6:
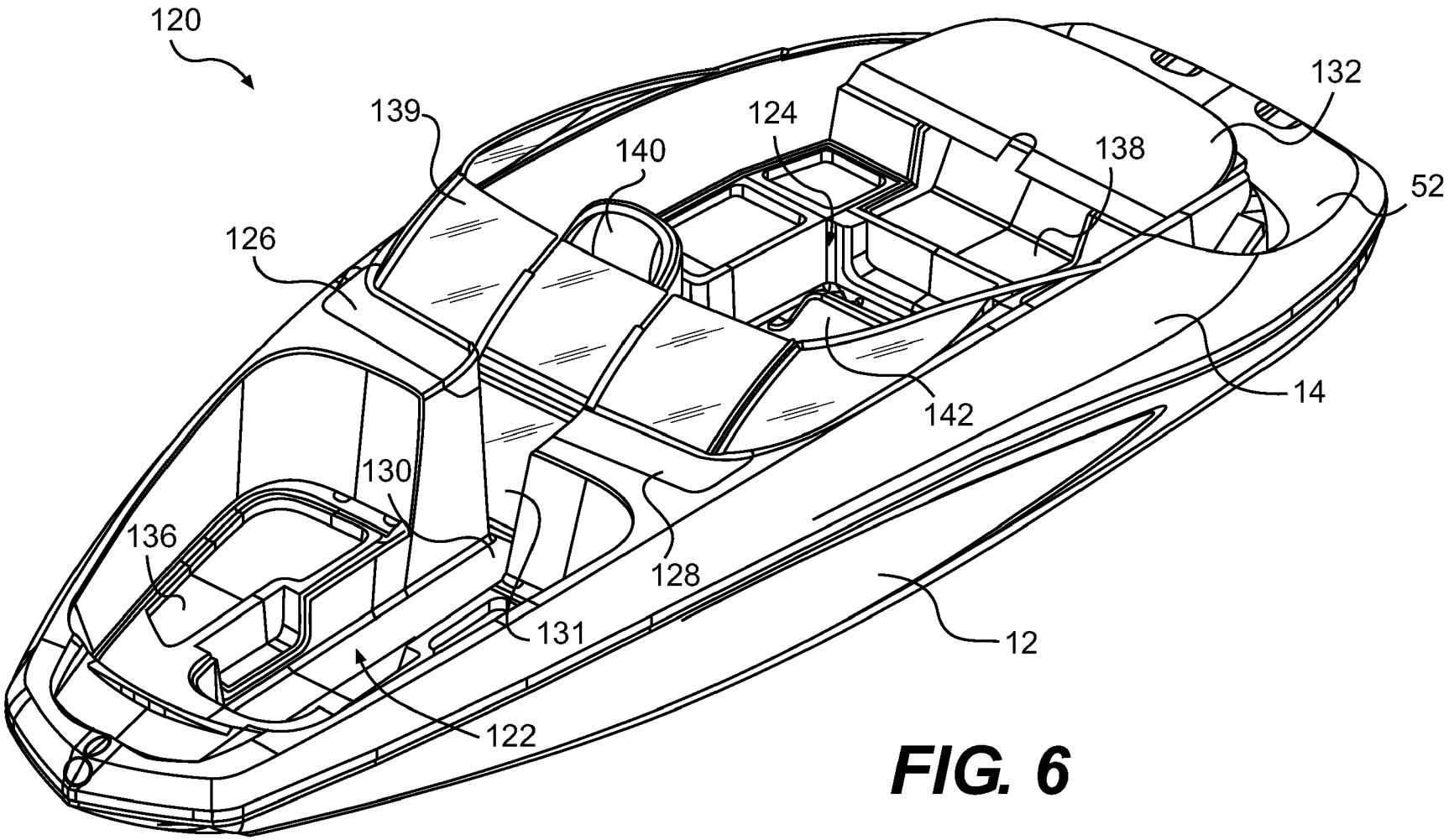
FIG. 6 is a perspective view, taken from a front, left side, of a sport boat in accordance with the invention.
Figure 7:
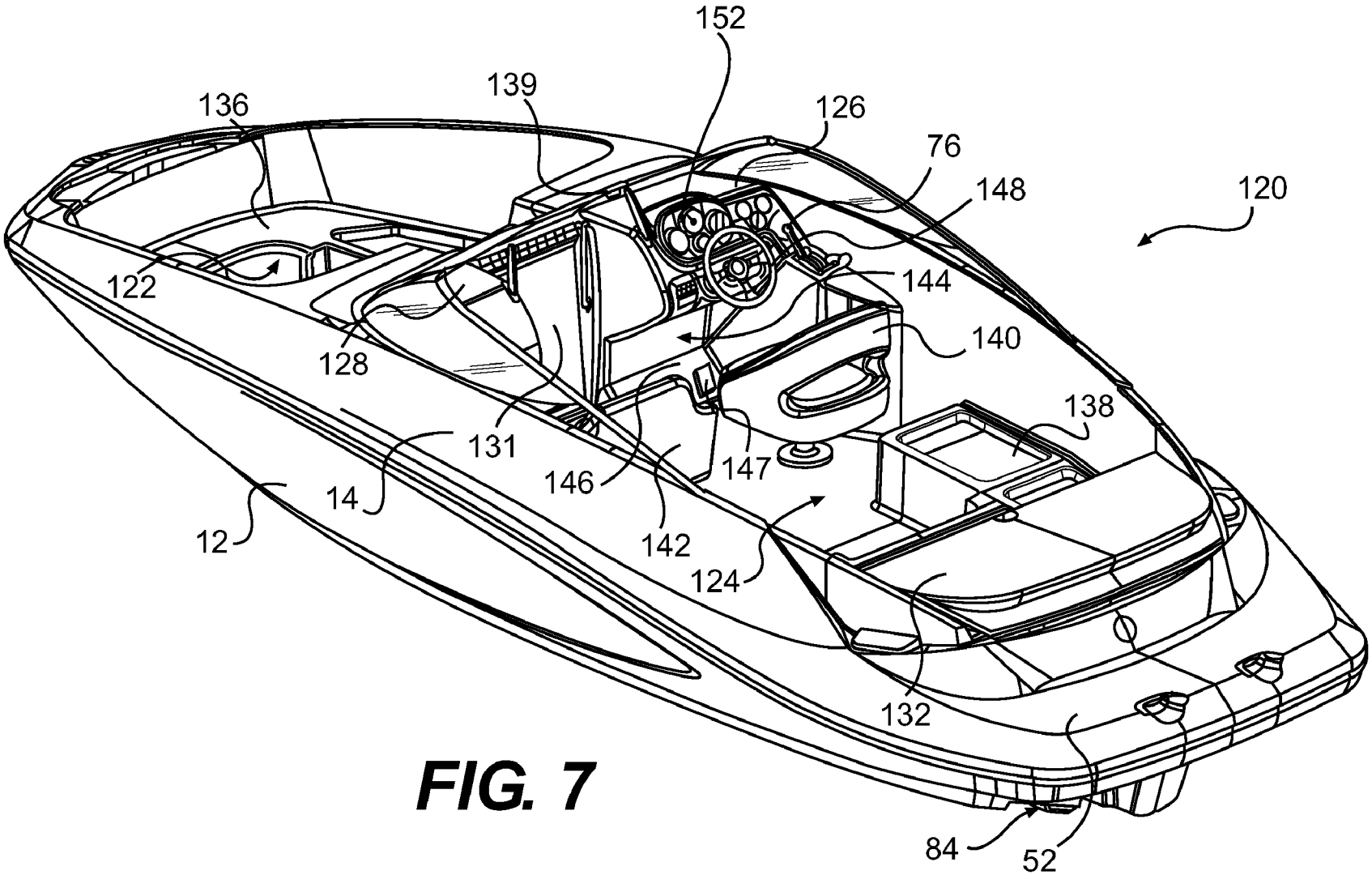
FIG. 7 is a perspective view, taken from a rear, left side, of the sport boat of FIG. 6.

The general construction of a sport boat 120 in accordance with this invention will now be described with respect to FIGS. 6 and 7. The following description relates to one way of manufacturing a sport boat. Obviously, those of ordinary skill in the sport boat art will recognize that there are other known ways of manufacturing and designing sport boats and that this invention would encompass other known ways and designs.

For simplicity, the components of the sport boat 120 which are similar in nature to the components of the personal watercraft 10 described above will be given the same reference numeral. It should be understood that their specific construction may vary however.

The sport boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one engine (not shown) is located between the hull 12 and the deck 14 at the back of the boat 120. The engine powers jet propulsion system 84 of the boat 120. The jet propulsion system 84 is of similar construction as the jet propulsion system 84 of the personal watercraft 10 described above, and in greater detail below, and will therefore not be described in detail here. It is contemplated that the boat 120 could have two engines and two jet propulsion systems 84. The engine is accessible through an engine cover 132 located behind the rearward passenger area 124. The engine cover 132 can also be used as a sundeck for a passenger of the boat 120 to sunbathe on while the boat 120 is not in motion. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A foot pedal 147 is provided on the footrest 146 which may be used to control the jet propulsion system 84 as described in greater detail below. The left console 128 has a similar recess (not shown) to accommodate the feet of the passenger sitting in the passenger seat 142. The right console 126 accommodates all of the elements necessary to the driver to operate the boat 120. These include, but are not limited to: a steering assembly including a steering wheel 148, a throttle operator 76 in the form of a throttle lever, and an instrument panel 152. The instrument panel 152 has various dials indicating the watercraft speed, engine speed, fuel and oil level, and engine temperature. The speed of the watercraft is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIGS. 8 to 20 the jet propulsion system 84 will be described. It should be understood that the jet propulsion system 84 being described is only one possible type of jet propulsion system and other types of jet propulsion systems are contemplated that would be encompassed by the present invention. As seen in FIG. 8, the jet propulsion system 84 is disposed in a tunnel 94 of the watercraft 10. It is contemplated that the jet propulsion system 84 could be mounted directly to the transom 54.

Figure 12:
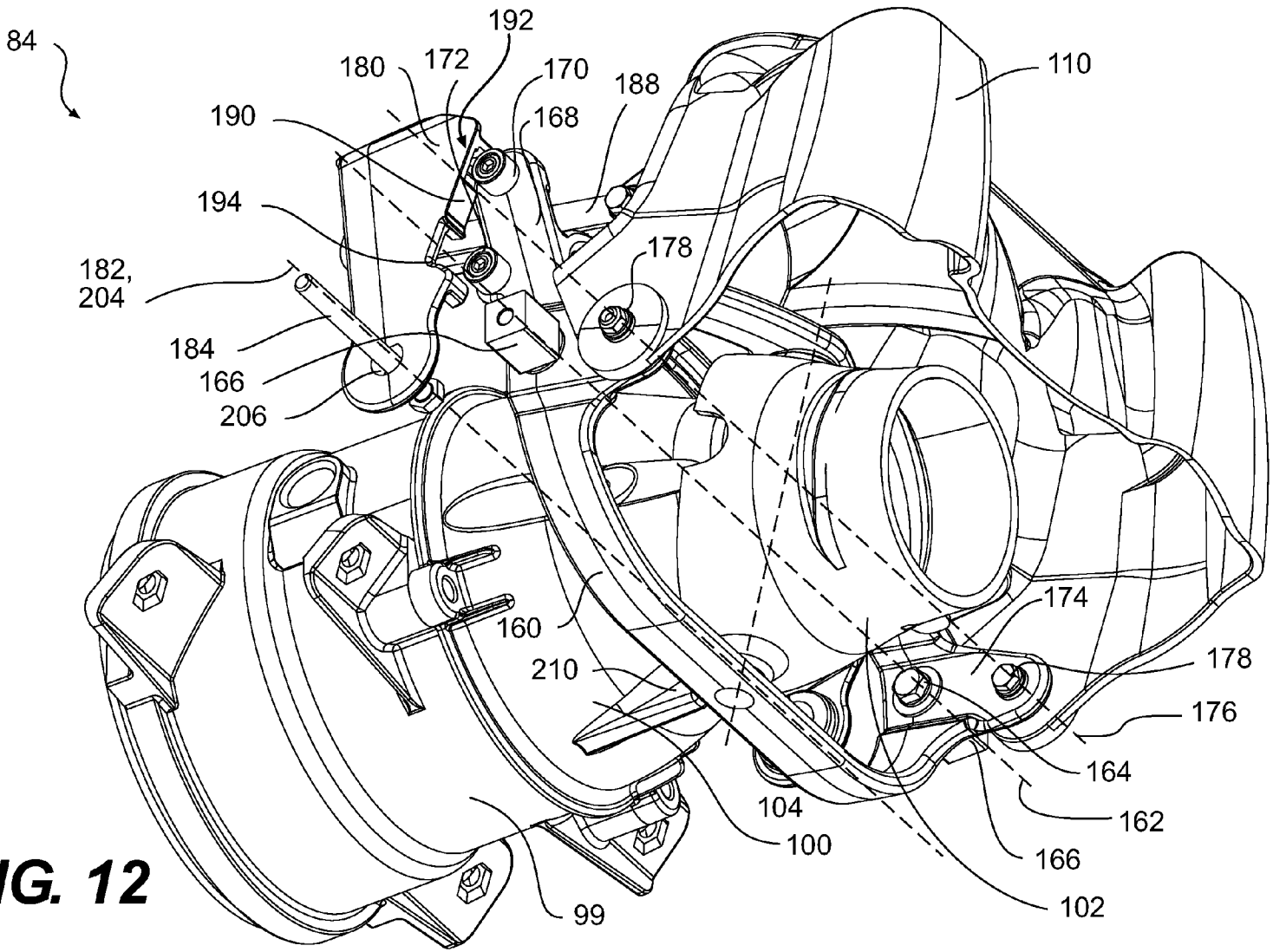
FIG. 12 is a bottom perspective view, taken from a rear, left side, of the jet propulsion system of FIG. 10 with the reverse gate in the stowed position.
Figure 13:
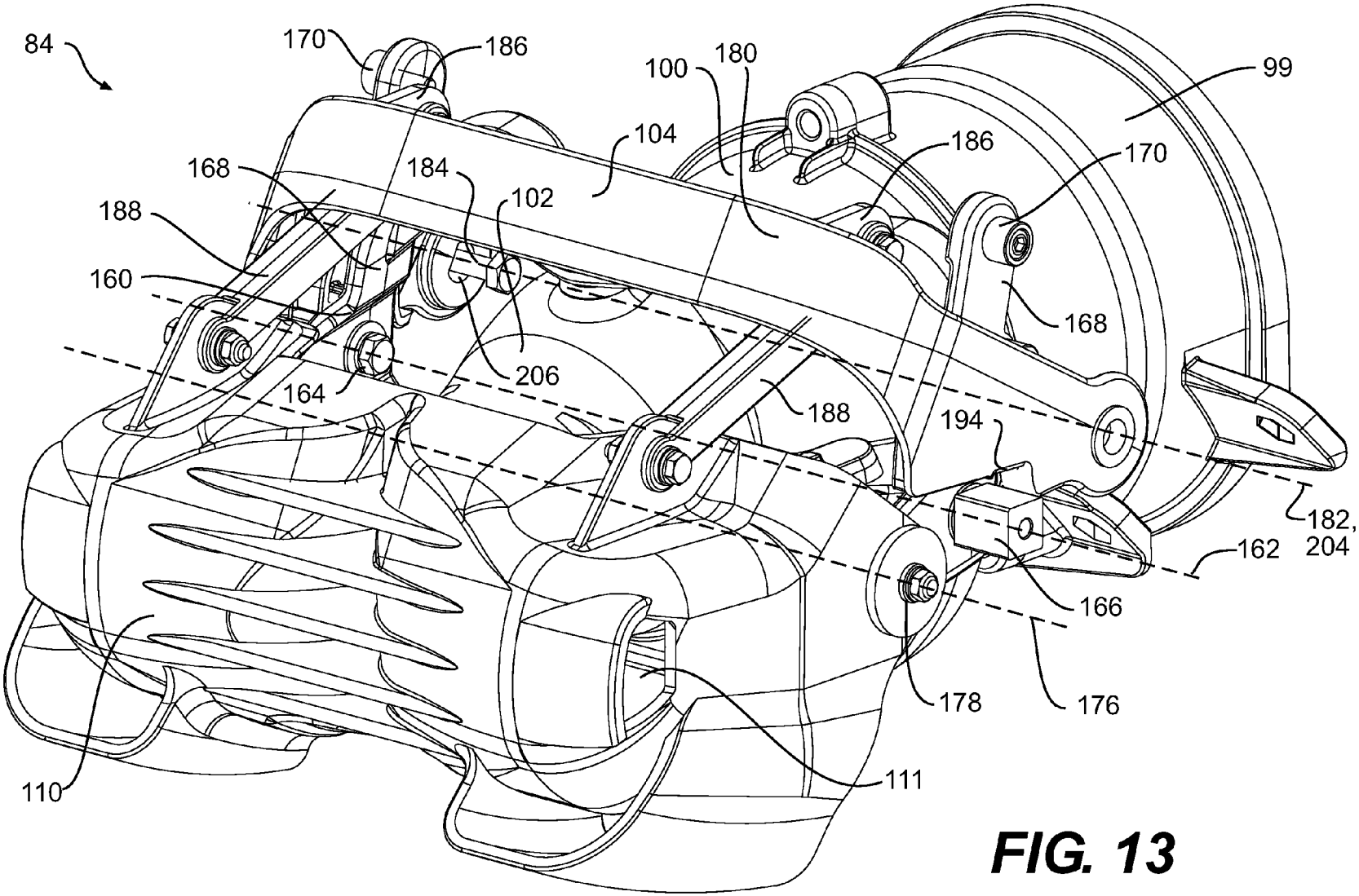
FIG. 13 is a perspective view, taken from a rear right side, of the jet propulsion system of FIG. 10 with the reverse gate in a fully lowered position.

As previously mentioned, the jet propulsion assembly 84 includes a jet pump 99, a venturi 100, a steering nozzle 102, and a reverse gate 110. A variable trim system (VTS) support 160 is rotationally mounted to two side plates 161 (FIG. 11) which are mounted to the two side walls 95 of the tunnel 94 (see FIG. 8) about a VTS axis 162. The VTS axis 162 extends generally laterally and horizontally. Bolts 164 are used to connect the VTS support 160 to the side plates 161. Spacer blocks 166 are provided between the VTS support 160 and the side plates 161 to prevent the VTS support 160 from moving laterally inside the tunnel 94. The right side plate 161 has an exhaust connector 163 which connects to the exhaust system (not shown) of the watercraft to allow the exhaust gases to be exhausted inside the tunnel 94. It is contemplated that the VTS support 160 could be rotationally mounted about the VTS axis 162 directly on the venturi 100. As best seen in FIG. 12, the VTS support 160 is in the shape of a ring which encircles the forward portion of the steering nozzle 102. The steering nozzle 102 is rotationally mounted at a top and bottom of the VTS support 160 about the steering axis 104 such that the steering nozzle 102 rotates with the VTS support 160 about the VTS axis 162 as described below. The steering axis 104 is generally perpendicular to the VTS axis 162. As seen in FIGS. 10 to 20, the VTS support 160 has a pair of upwardly extending arms 168. A first guide pin 170 is disposed on each of the arms 168 at a position vertically higher than the VTS axis 162. A second guide pin 172 is disposed on each of the arms 168 at a position vertically higher than the VTS axis 162 and vertically lower than the first guide pin 170. The function of guide pins 170, 172 will be described below. The VTS support 160 also has a pair of rearwardly extending arms 174 to which the reverse gate 110 is rotationally mounted about a reverse gate axis 176 by nuts and bolts 178. The reverse gate axis 176 extends generally laterally and horizontally, and is disposed rearwardly of the VTS axis 162.

Figure 10:
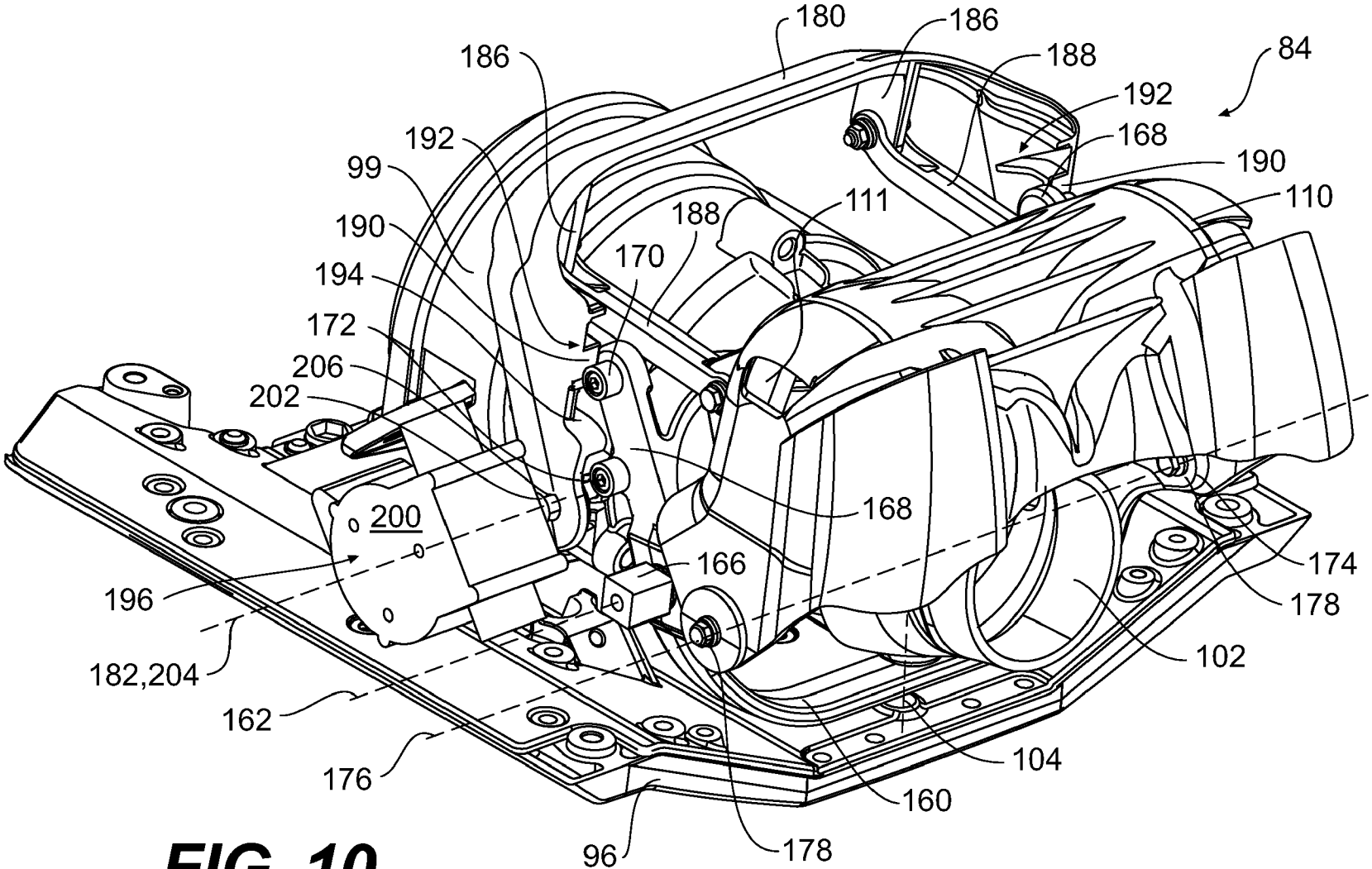
FIG. 10 is a perspective view, taken from a rear, left side, of a jet propulsion system with a reverse gate in a stowed position.
Figure 11:
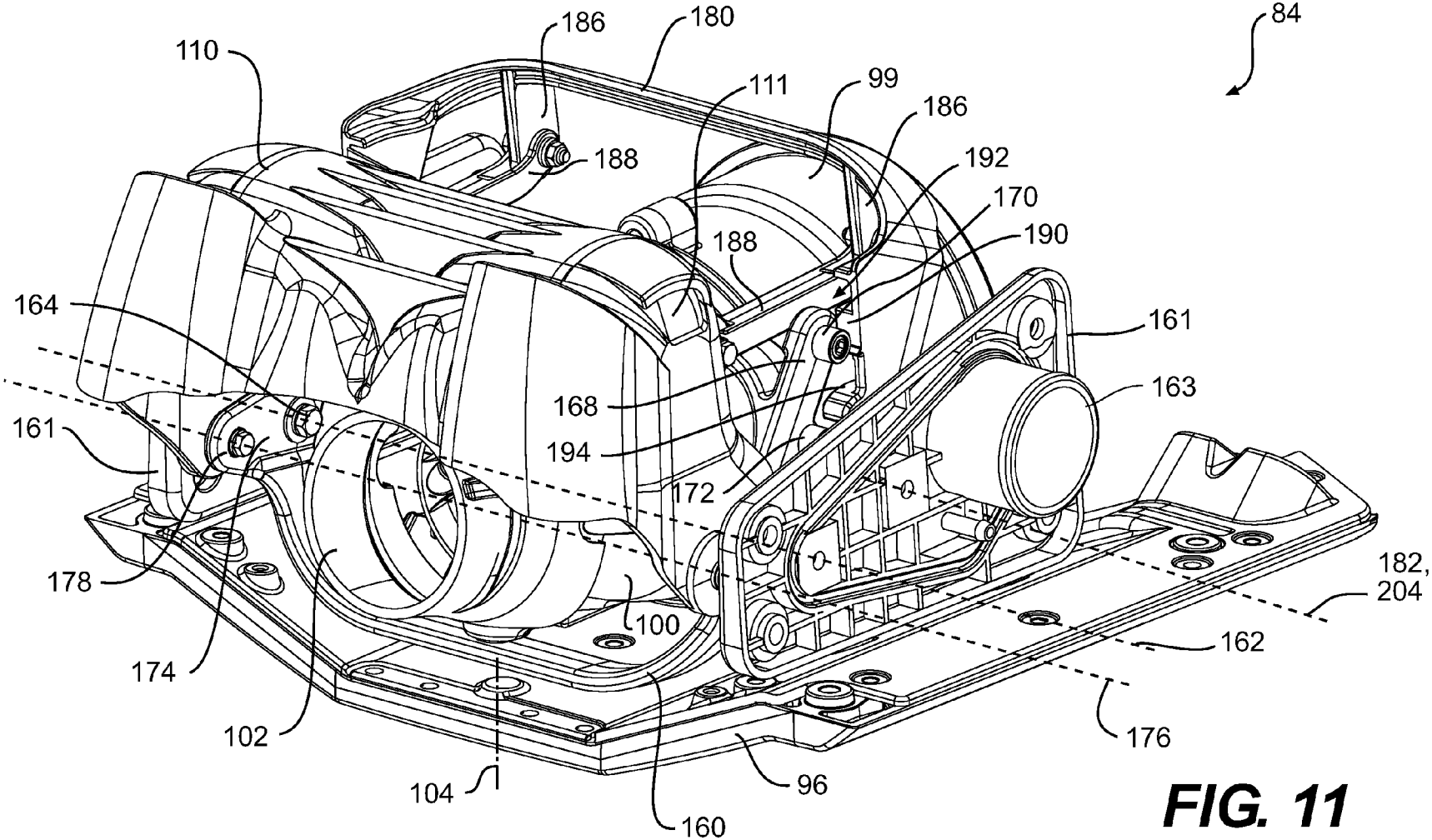
FIG. 11 is a perspective view, taken from a rear, right side, of the jet propulsion system of FIG. 10 with the reverse gate in the stowed position.

The jet propulsion system 84 is also provided with a main support 180 that is rotationally mounted to the two side plates 161 (FIG. 11) about a main support axis 182. The main support axis 182 extends generally laterally and horizontally. Bolts 184 (FIG. 12) are used to connect the main support 180 to the right side plate 161 and to the rotary actuator 196 (described below). The main support axis 182 is disposed forwardly of the VTS axis 162. It is contemplated that the main support 180 could be rotationally mounted about the main support axis 182 directly on the jet pump 99 or venturi 100. The main support 180 has an inverted U-shape. The upper portion of the main support 180 has a pair of downwardly extending tabs 186. Each tab 186 is pivotally connected to a first portion of a link 188 with a nut and a bolt. The second, opposite, portion of each link 188 is pivotally connected to the reverse gate 110 at a point vertically higher than the reverse gate axis 176 with a nut and a bolt. It is contemplated that only one or more than two tabs 186 and links 188 could be used. As best seen in FIG. 10, the main support 180 defines contact surfaces 190 on a rearwardly facing side thereof. As described in greater detail below, the first guide pins 170 contact the contact surfaces 190 in at least some arrangements of the VTS support 160 and the main support 180. As seen in FIGS. 10 and 17 to 20, the main support 180 also defines slots 192 therein which have an opening at an upper end of the contact surfaces 190. As described in greater detail below, the first guide pins 170 are disposed in the slots 192 in at least some arrangements of the VTS support 160 and the main support 180. As also seen in FIGS. 10 and 17 to 20, the main support 180 also defines ramps 194 which are disposed vertically below the slots 192 when the main support 180 is in the position shown in FIG. 17. The ramps 194 have an arcuate surface corresponding to a segment of a circle having the main support axis 182 as a center. As described in greater detail below, the second guide pins 172 contact the arcuate surfaces of the ramps 194 in at least some arrangements of the VTS support 160 and the main support 180.

Figure 9:
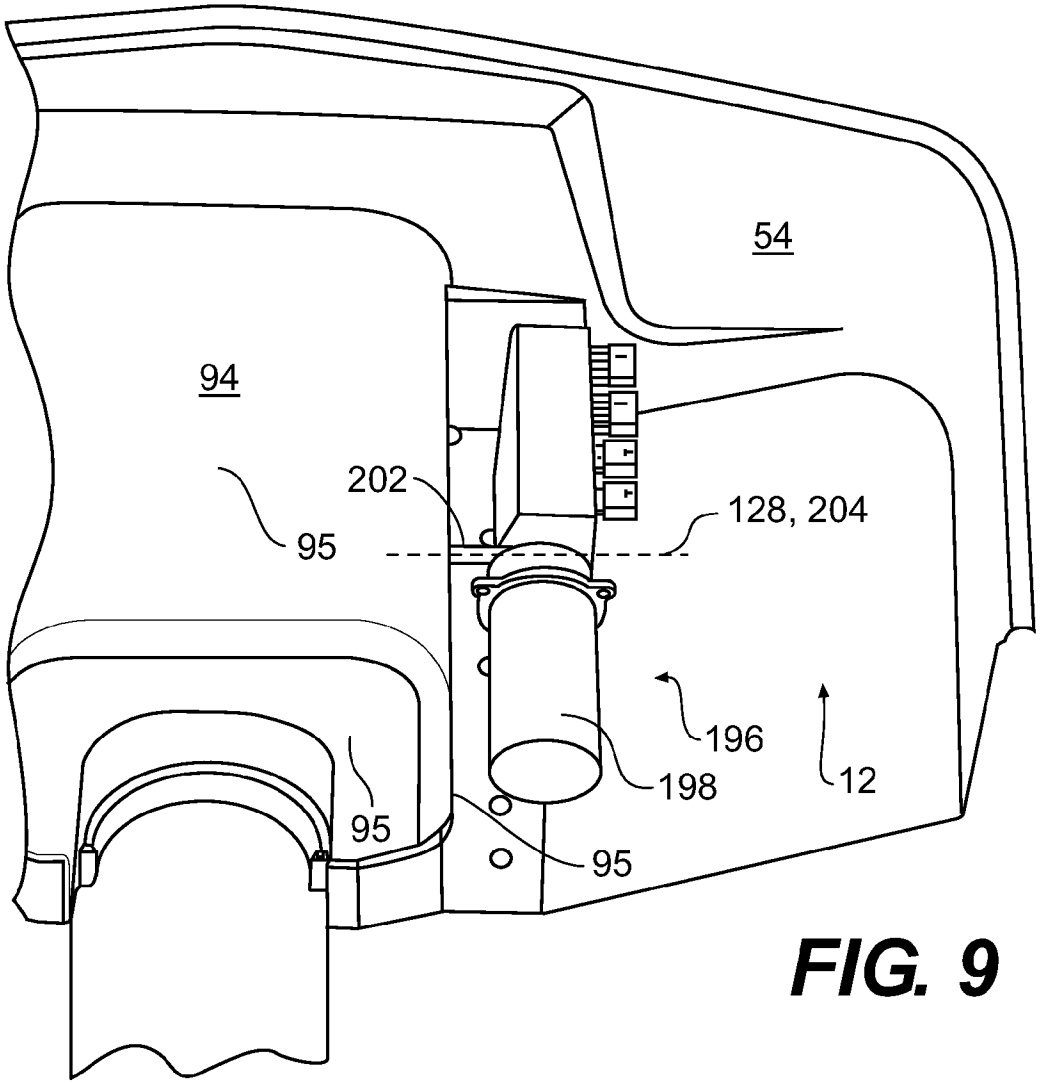
FIG. 9 is a top perspective view of a rear portion of the hull of the personal watercraft of FIG. 1.

As seen in FIGS. 9 and 10, the jet propulsion system 84 is provided with a reverse gate actuator in the form of a rotary actuator 196 disposed inside the hull 12 adjacent the left side wall 95 of the tunnel 94, thus limiting the exposure of the actuator 196 to water. The rotary actuator 196 includes a rotary electric motor 198 connected to a gear box 200 having an output portion 202. The gear box 200 transfers the rotation from an output shaft (not shown) of the rotary electric motor 198 to the output portion 202 which is perpendicular to the output shaft. It is contemplated that a power screw could be used to transfer the rotation from the output shaft of the rotary electric motor 198 to the output portion 202. The output portion 202 passes through the left side wall 95 and left side plate 161 and connects to the main support 180 so as to rotate the main support 180 about the main support axis 182 as described in greater detail below. The axis of rotation 204 of the output portion 202 is coaxial with the main support axis 182. The end of the output portion 202 has a flat part and fits inside a hole 206 in the main support 180 having a corresponding flat part so as to prevent relative rotation between the output portion 202 and the main support 180. It is contemplated that other ways of preventing relative rotation between the output portion 202 and the main support 180 could be used. It is also contemplated that other types of reverse gate actuators could be used, such as, for example, a hydraulic actuator. The rotary actuator 196 is controlled based on signals received from one or more of the lever 77, and buttons 80 for the personal watercraft 10, and from one or more of the pedal 147, buttons (not shown), and lever (not shown) for the boat 120, or from a steering assembly position sensor 236 (FIG. 21), or other sensors as described in greater detail below, so as to provide the VTS position and reverse gate position desired by the driver of the watercraft. It is contemplated that the rotary actuator 196 could be automatically controlled without any driver intervention based on conditions of the watercraft and engine such as vehicle speed and engine speed so as to provide the most appropriate VTS position and reverse gate position. It is also contemplated that a combination of automatic control and driver input could be used to control the rotary actuator 196. For example, the VTS position and some reverse gate positions could be automatically controlled, but the driver (through a lever, button, or pedal) would provide the input to the rotary actuator 196 that a reverse operation of the watercraft is desired. One such automatic control of the reverse gate 110 is described in greater detail below.

Turning now to FIGS. 14 to 20, the operation of the jet propulsion system 84, and more specifically the movement of the main support 180, VTS support 160, steering nozzle 102, and reverse gate 110, will be described. It should be understood that FIGS. 14 to 20 only show some of the arrangements of these components and that arrangements intermediate those shown are possible. For simplicity, the description will be made only with respect to the left side of the jet propulsion system 84. Although not specifically shown in these figures, it should also be understood that a position of the output portion 202 of the rotary actuator 196 corresponds to a position of the main support 180. As such, when the main support 180 is shown as having been rotated by a certain number of degrees in one direction from one position to another, it should be understood that this rotation was caused by the output portion 202 rotating by the same number of degrees in the same direction.

Figure 14:
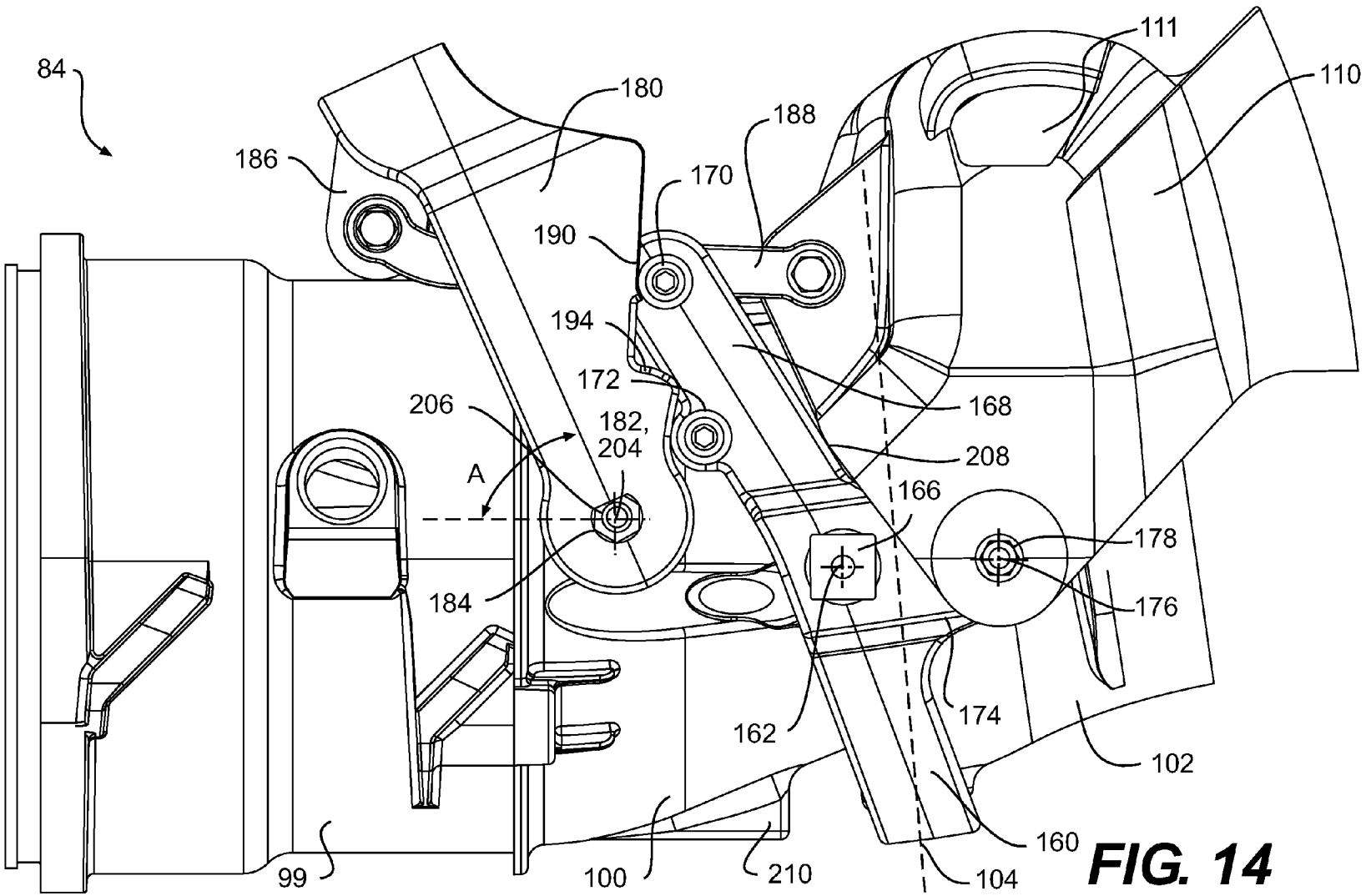
FIG. 14 is a left side view of the jet propulsion system of FIG. 10 with the variable trim system (VTS) in a VTS up position and the reverse gate in a stowed position.

In the arrangement shown in FIG. 14, the main support 180 is in a first position that is an angle A from horizontal. The VTS support 160 is in a VTS up position where the steering nozzle 102 directs a jet of water from the venturi 100 slightly upwardly. The reverse gate 110 is in a stowed position (i.e. a position where it does not interfere with the jet of water coming from the steering nozzle 102). Unless the main support 180 is rotated by the output portion 202, the VTS support 160 is prevented from rotating counter-clockwise since the first guide pin 170 contacts the contact surface 190 and is prevented from rotating clockwise since the reverse gate 110 contacts a contact point 208 located vertically higher than the VTS axis 162 on the arm 168 of the VTS support 160. The reverse gate 110 is prevented from rotating clockwise by link 188.

Figure 15:
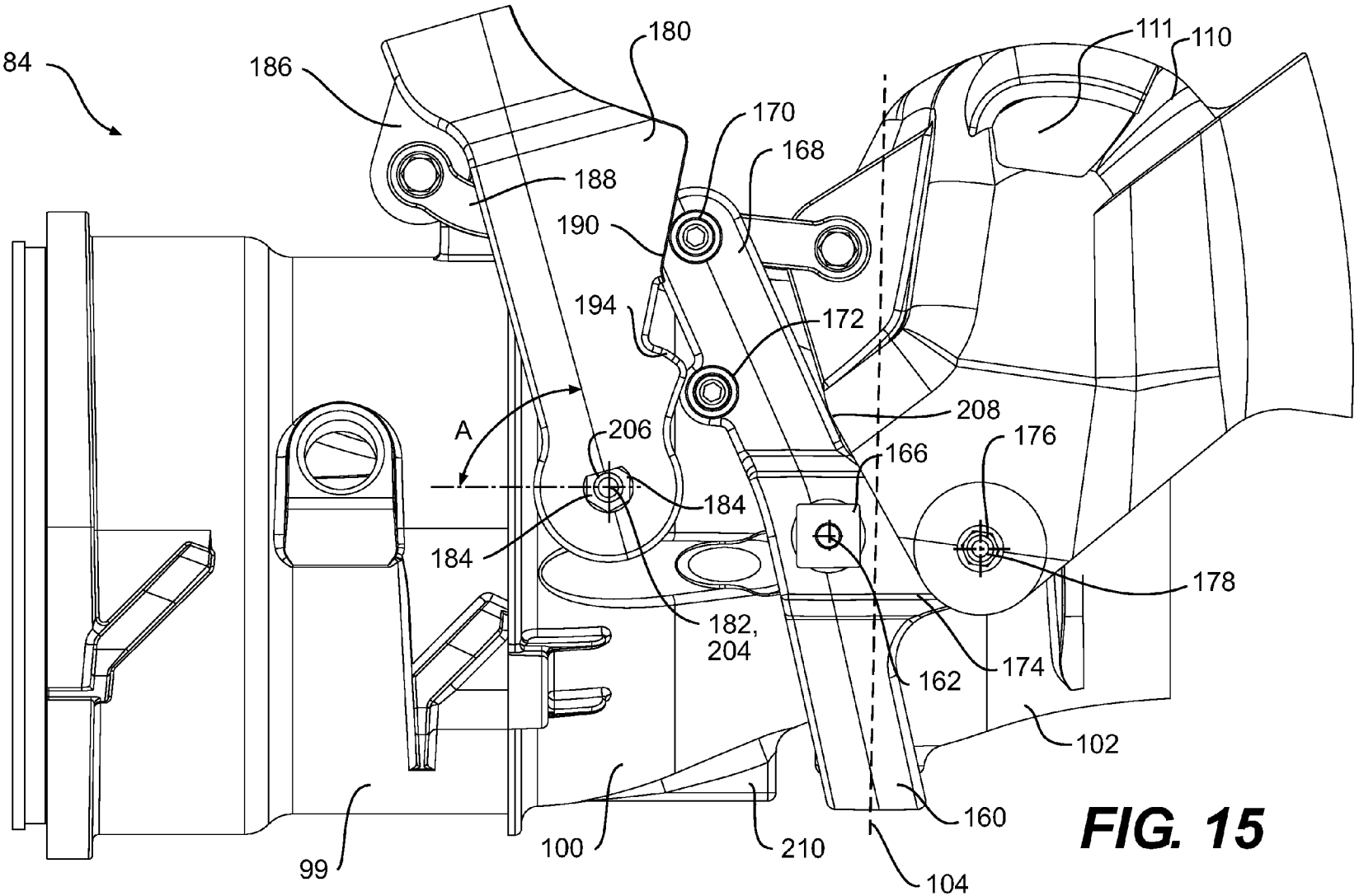
FIG. 15 is a left side view of the jet propulsion system of FIG. 10 with the VTS in a VTS neutral position and the reverse gate in a stowed position.
Figure 16:
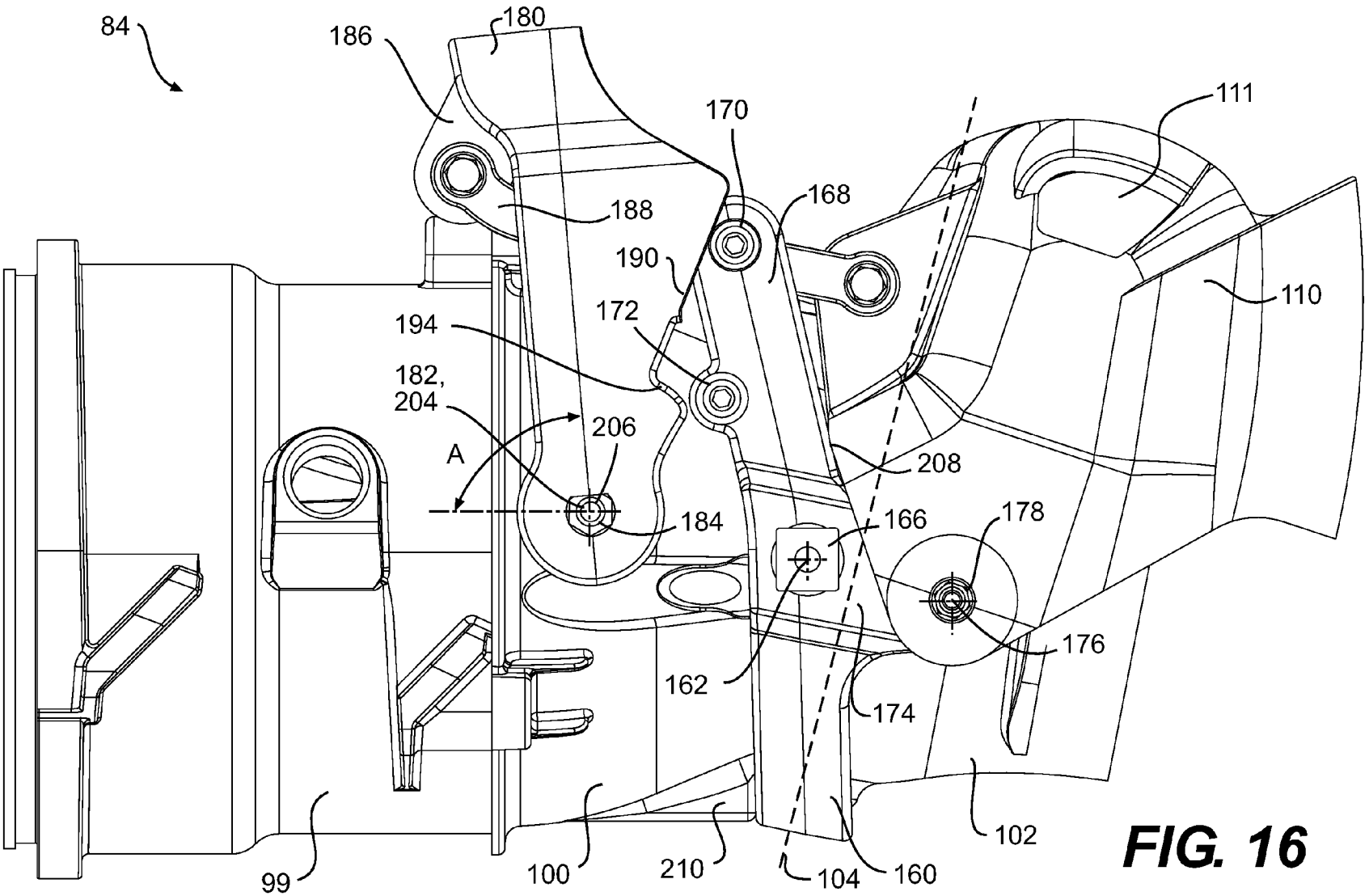
FIG. 16 is a left side view of the jet propulsion system of FIG. 10 with the VTS in a VTS down position and the reverse gate in a stowed position.
Figure 17:
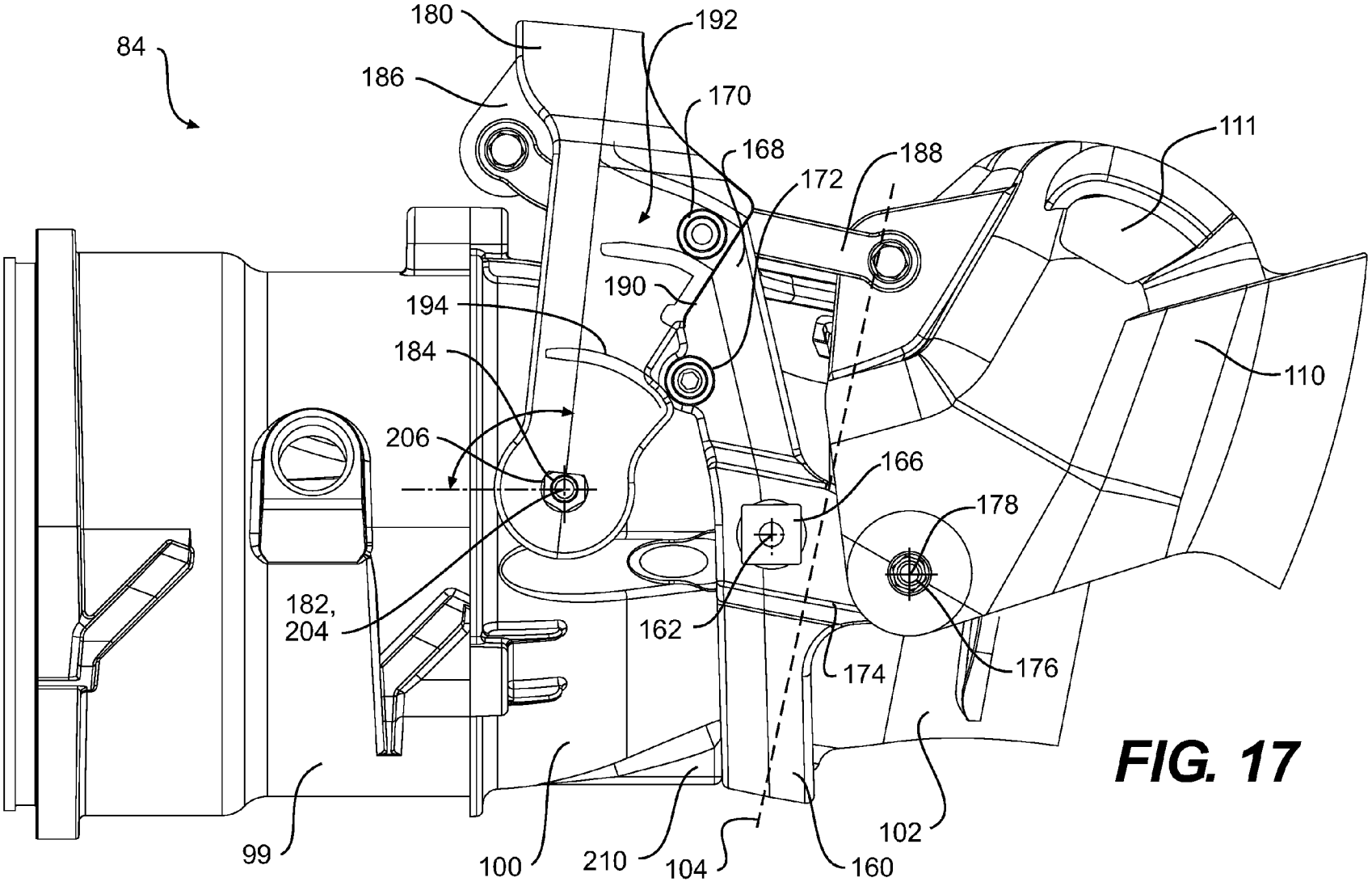
FIG. 17 is a left side view of the jet propulsion system of FIG. 10 with the VTS in a VTS down position and the reverse gate in a first lowered position.
Figure 18:
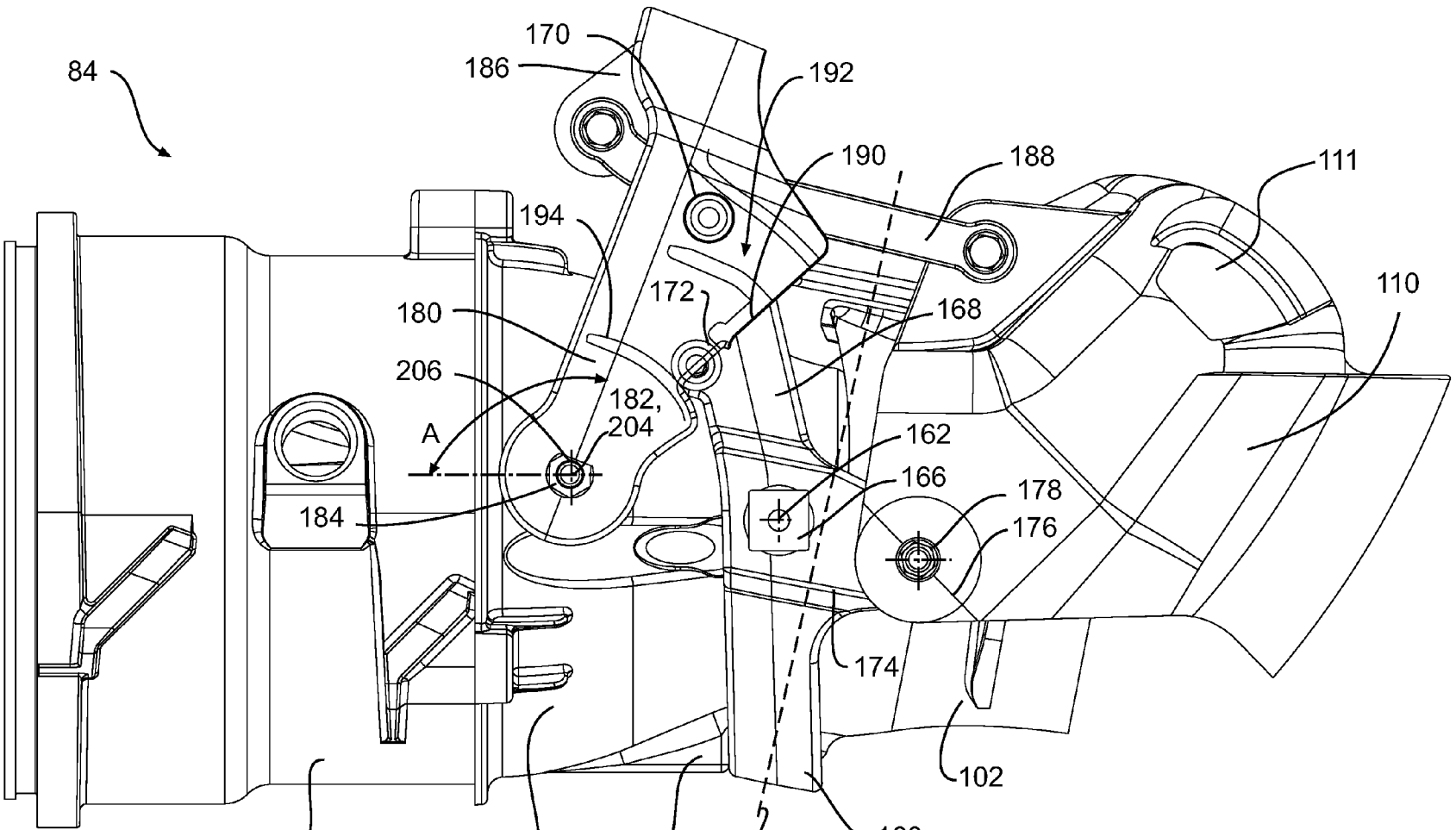
FIG. 18 is a left side view of the jet propulsion system of FIG. 10 with the VTS in a VTS down position and the reverse gate in a second lowered position.
Figure 19:
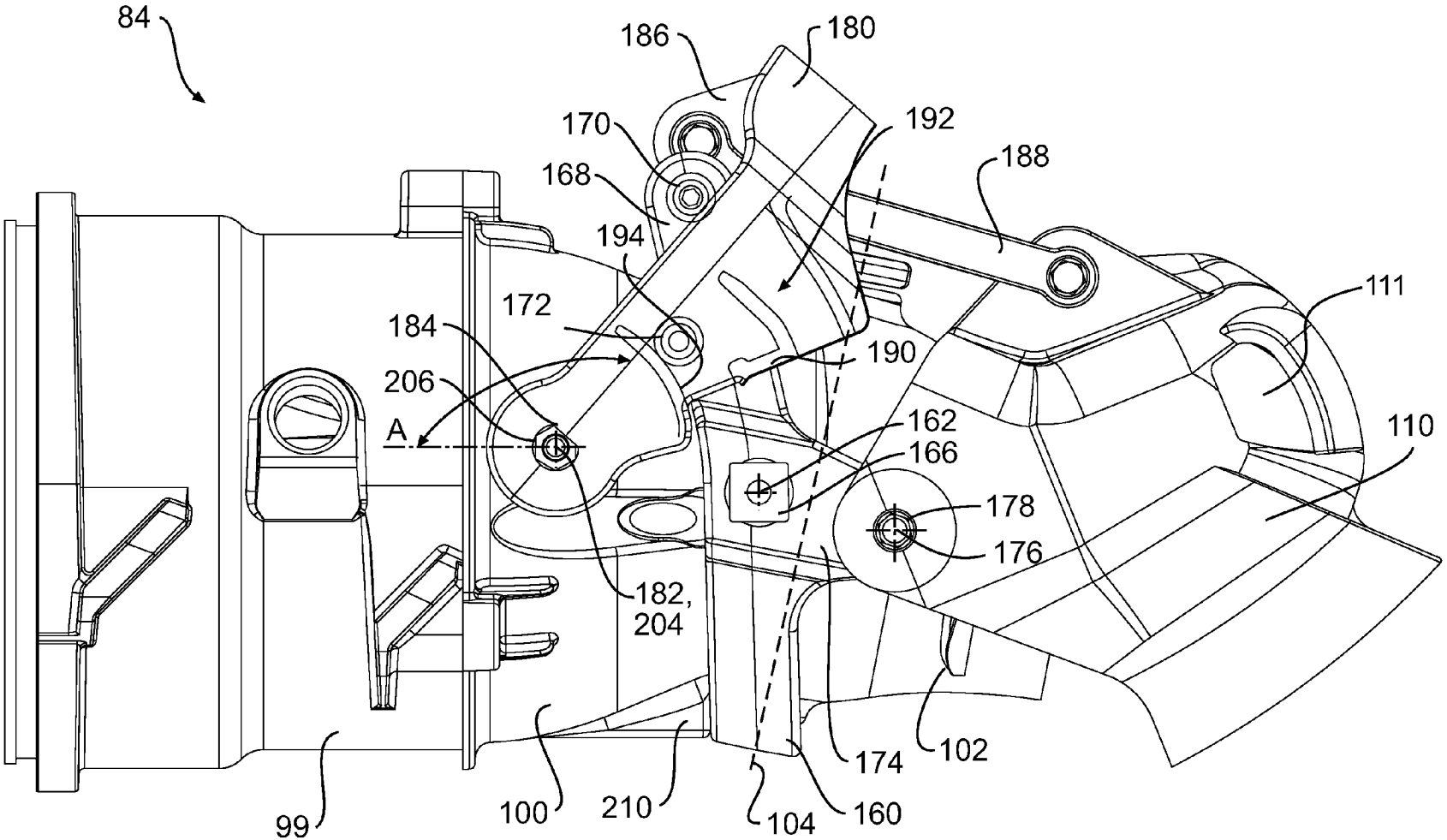
FIG. 19 is a left side view of the jet propulsion system of FIG. 10 with the VTS in a VTS down position and the reverse gate in a third lowered position.

As the output portion 202 is rotated clockwise, the main support 180 also rotates clockwise about the main support axis 182 from the position shown in FIG. 14 to the position shown in FIG. 15, and then to the position shown in FIG. 16, and as such the angle A increases. As the main support 180 rotates, the guide pin 170 slides upwardly along the contact surface 190, causing the VTS support 160 to rotate clockwise about the VTS axis 162. As the VTS support 160 rotates clockwise from the position shown in FIG. 14 to the position shown in FIG. 16, the reverse gate axis 176, and therefore the reverse gate 110, moves in an arc about the VTS axis 162. As such, the position of the reverse gate 110 relative to the VTS support 160 remains substantially the same (i.e. the stowed position) and the reverse gate 110 continues to contact the contact point 208. Therefore, for each position of the main support 180 between the position shown in FIG. 14 and the position shown in FIG. 16 there is a single corresponding position of the VTS support 160 since the VTS support is held between the contact surface 190 (by first guide pin 170) and the reverse gate 110. In the arrangement shown in FIG. 15, the VTS support 160 is in a VTS neutral position where the steering nozzle 102 directs a jet of water from the venturi 100 generally horizontally, and the reverse gate 110 is in the stowed position. In the arrangement shown in FIG. 16, the VTS support 160 is in a VTS down position where the steering nozzle 102 directs a jet of water from the venturi 100 slightly downwardly, and the reverse gate 110 is in a stowed position.

As the output portion 202 continues to be rotated clockwise, the main support 180 also continues to rotate clockwise about the main support axis 182 from the position shown in FIG. 16 to the positions shown in FIGS. 17 to 20 consecutively, and as such the angle A continues to increase. Since, as shown in FIGS. 16 to 20, the bottom portion of the VTS support 160 contacts a stopper portion 210 of the venturi 100, to permit the continued rotation of the main support 180 the first guide pin 170 enters slot 192. The VTS support 160 is maintained in the VTS down position in the arrangements shown in FIGS. 17 to 20 by having the second guide pin 172 contact the arcuate surface of the ramp 194, thus preventing counter-clockwise rotation of the VTS support 160 about the VTS axis 162, which would otherwise occur due to the force of the water jet on the steering nozzle 102. Since the VTS support 160 is maintained in the VTS down position, the reverse gate axis 176 remains in position. Therefore, as the main support 180 is rotated clockwise, the link 188 pushes on the reverse gate 110 which no longer contacts the contact point 208 and rotates about the reverse gate axis 176 to the positions shown in FIGS. 17 to 20 consecutively. In the positions shown in these figures, the reverse gate 110 redirects the jet of water expelled from the steering nozzle 102. In the position shown in FIG. 18, the jet of water is redirected generally downwardly and as such the jet of water does not thrust the watercraft forward or backward. In the position shown in FIG. 20, most of the jet of water is redirected towards a front of the watercraft which causes the watercraft to move in the reverse direction.

In summary, as the output portion 202 of the rotary actuator 196 rotates the main support 180 from the position shown in FIG. 14 to the position shown in FIG. 16, the VTS support 160 rotates from the VTS up position to the VTS down position, while the reverse gate 110 remains in the stowed position. As the output portion 202 of the rotary actuator 196 continues to rotate the main support 180 from the position shown in FIG. 16 to the position shown in FIG. 20, the reverse gate 110 rotates about the reverse gate axis 176 to redirect the jet of water being expelled from the steering nozzle 102, while the VTS support 160 remains in the VTS down position.

Figure 20:
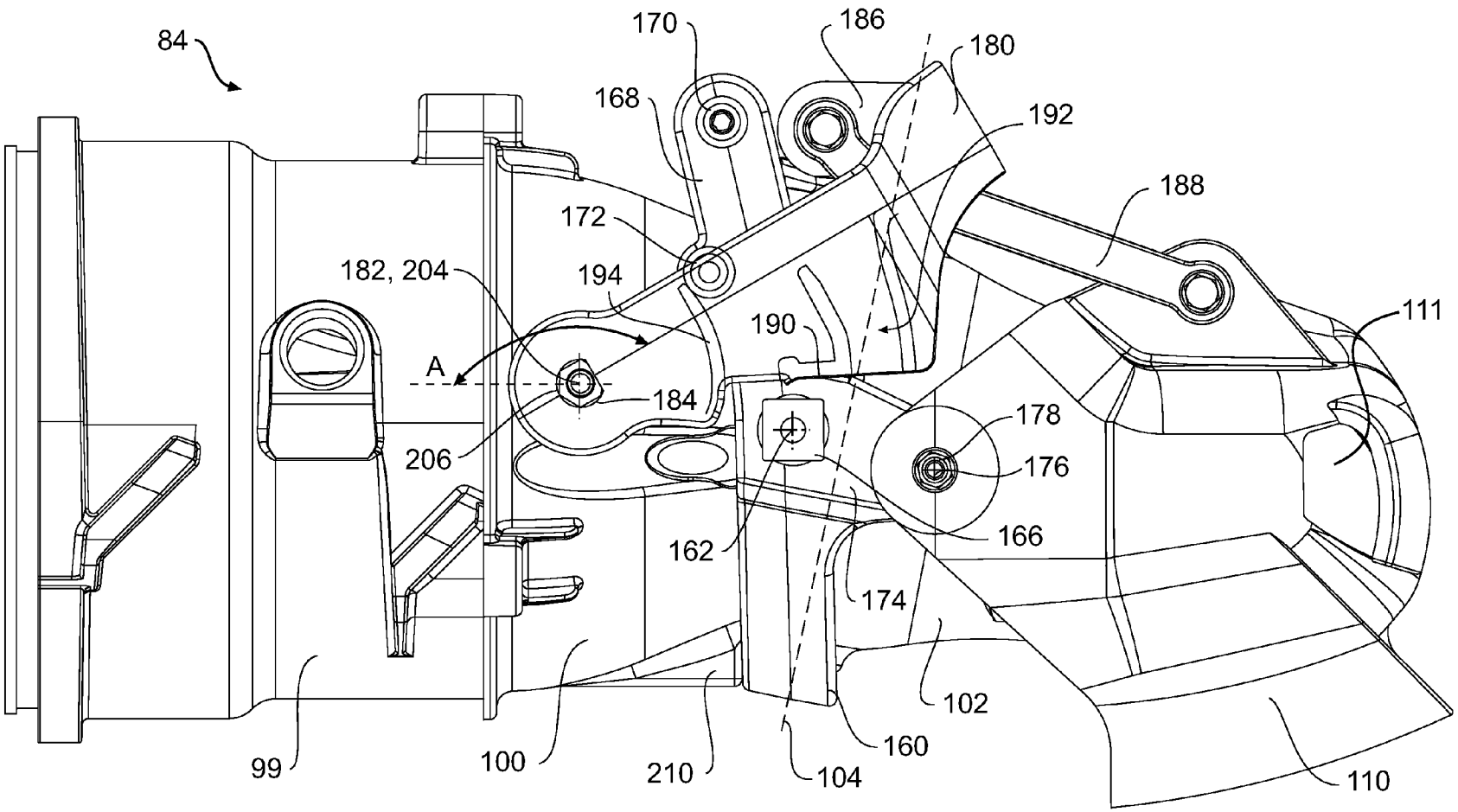
FIG. 20 is a left side view of the jet propulsion system of FIG. 10 with the VTS in a VTS down position and the reverse gate in a fully lowered position.

From FIG. 20, when the output portion 202 rotates counter-clockwise, the main support 180 rotates counter-clockwise, the link 188 pulls on the reverse gate 110 causing it to rotate counter-clockwise about the reverse gate axis 176, and the VTS support 106 remains fixed in the VTS down position until the position shown in FIG. 16. As the output portion 202 continues to rotate counter-clockwise from the position shown in FIG. 16, the reverse gate 110 contacts the contact point 208 and continues to be pulled by the link 188 causing the VTS support 160 to rotate counter-clockwise about the VTS axis 162, and the reverse gate 110 remains in the stowed position relative to the steering nozzle 102. It should be understood that the direction of rotation of the output portion 202 can be changed at any time (i.e. it does not need to be rotated from the position shown in FIG. 14 to the position shown in FIG. 20 before it can be rotated counter-clockwise, and vice versa). It should also be understood that the rotation of the output portion 202 can be stopped at any time to maintain a desired arrangement of the components.

It is contemplated that the rotary actuator 196 could be operatively connected to the VTS support 160 and the reverse gate 110 via components other than the main support 180 and still operate as described above. For example, it is contemplated that a system of cams and/or gears could be used.

Figure 21:
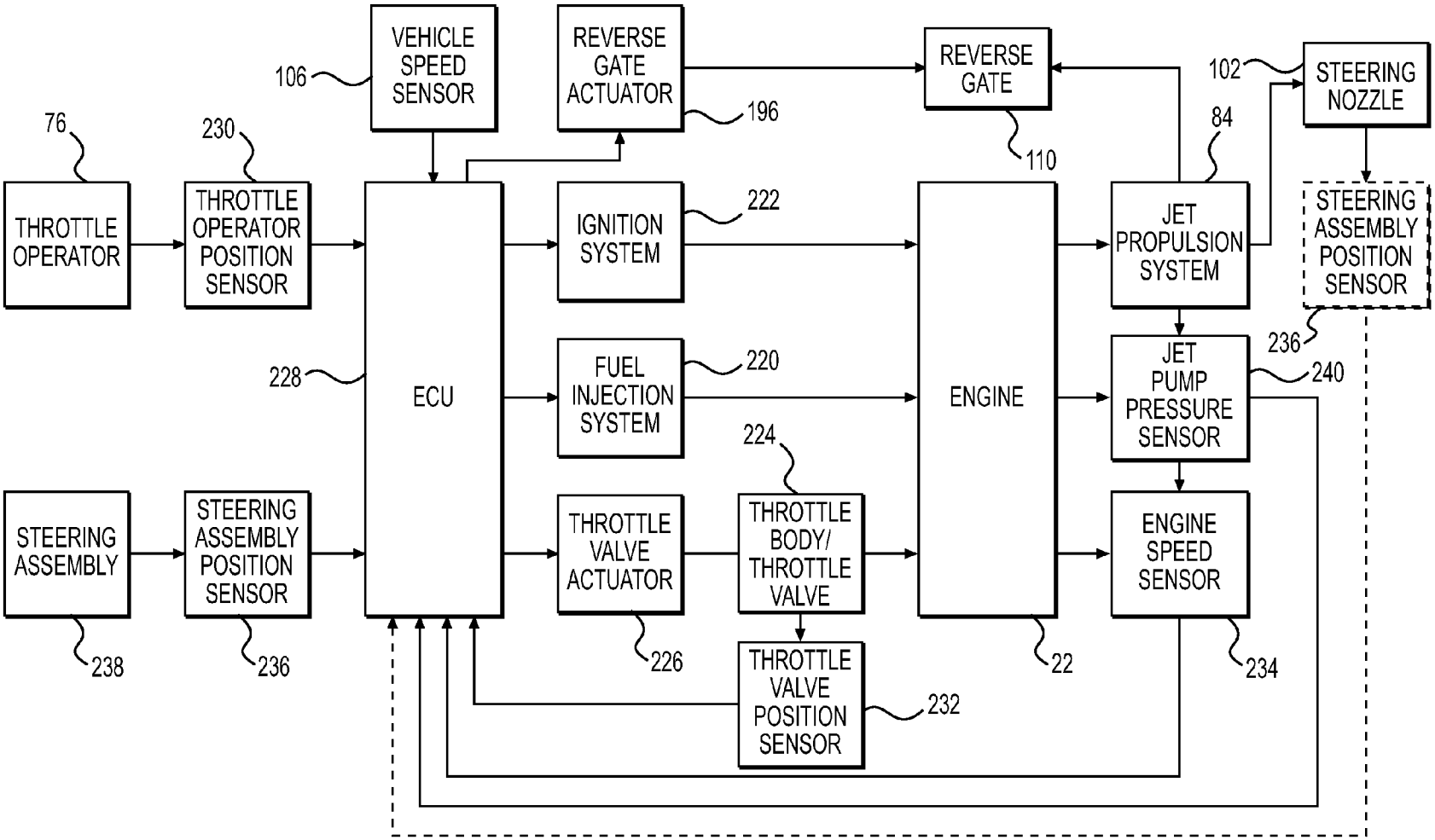
FIG. 21 is a schematic representation of the various sensors and vehicle components present in a watercraft in accordance with the present invention.

Turning now to FIG. 21, the various sensors and vehicle components present in a watercraft in accordance with the present invention, such as those described above, will now be described. As it would be understood by those skilled in the art, not every sensor or component illustrated in FIG. 21 is required to achieve aspects of the present invention. As would also be understood by those skilled in the art, depending on the particular aspect of the invention, some of the sensors and components could be omitted, some of the sensors and components could be substituted by other types of sensor and components, and two or more sensors could be combined in a single sensor that can be used to perform multiple functions without departing from the scope of the present invention. For simplicity, the sensors and components will be described with reference to the personal watercraft 10. However, it should be understood that the sport boat 120 is provided with the same sensors and components.

As can be seen in FIG. 21, the engine 22 has a fuel injection system 220 and an ignition system 222 to control the amount of fuel provided to the engine 22 and combustion of a fuel/air mixture respectively. A throttle body having a throttle valve 224 controls the amount of air provided to the engine 22. A throttle valve actuator 226, preferably in the form of an electric motor, is connected to the throttle valve 224 to move the throttle valve 224 to a desired position. The ECU 228, disposed in the watercraft 10 and used to control the operation of various elements of the watercraft 10, is in electronic communication with various sensors from which it receives signals. The ECU 228 uses these signals to control the operation of the ignition system 222, the fuel injection system 220, and the throttle valve actuator 226 in order to control the engine 22.

A throttle operator position sensor 230 senses a position of the throttle operator 76 and sends a signal representative of the throttle operator position to the ECU 200. As previously mentioned, the throttle operator 76 can be of any type, but is preferably selected from a group consisting of a thumb-actuated throttle lever, a finger-actuated throttle lever, and a twist grip. The throttle operator 76 is normally biased, typically by a spring, towards a position that is indicative of a desire for an idle operation of the engine 22 known as the idle position. In the case of a thumb or finger-actuated throttle lever, this is the position where the lever is furthest away from the handle to which it is mounted. For purposes of this application, other positions of the throttle operator will be referred to as being greater than the idle position. For example, a position of the throttle operator 76 that has been moved by 10 degrees from the idle position is less than a position of the throttle operator 76 that has been moved by 15 degrees from the idle position, and the idle position is less than both of these positions.

Depending on the type of throttle operator 76, the throttle operator position sensor 230 is generally disposed in proximity to the throttle operator 76 and senses the movement of the throttle operator 76 or the linear displacement of a cable connected to the throttle operator 76. The throttle operator position sensor 230 is preferably in the form of a magnetic position sensor. In this type of sensor, a magnet is mounted to the throttle operator 76 and a sensor chip is fixedly mounted in proximity to the magnet. As the magnet moves, due to movement of the throttle operator 76, the magnetic field sensed by the sensor chip varies. The sensor chip transmits a voltage corresponding to the sensed magnetic field, which corresponds to the position of the throttle operator 76, to the ECU 228. It is contemplated that the sensor chip could be the one mounted to the throttle operator 76 and that the magnet could be fixedly mounted in proximity to the sensor chip. The throttle operator position sensor 230 could also be in the form of a rheostat. A rheostat is a resistor which regulates current by means of variable resistance. In the present case, the position of the throttle operator 76 would determine the resistance in the rheostat which would result in a specific current being transmitted to the ECU 228. Therefore, this current is representative of the position of the throttle operator 76. It is contemplated that other types of sensors could be used as the throttle operator position sensor 230, such as a potentiometer which regulates voltage instead of current.

The vehicle speed sensor 106 senses the speed of the vehicle and sends a signal representative of the speed of the vehicle to the ECU 228. The ECU 228 sends a signal to a speed gauge located in the display cluster 78 of the watercraft 10 such that the speed gauge displays the watercraft speed to the driver of the watercraft.

A throttle valve position sensor 232 senses the position (i.e. the degree of opening) of the throttle valve 224 and sends a signal representative of the position of the throttle valve 224 to the ECU 228. For purposes of this application, the lower the degree of opening of the throttle valve 224 is, the lower the position of the throttle valve 224 is considered to be. The ECU 228 uses the signal received from the throttle valve position sensor 232 as a feedback to determine if the throttle valve actuator 226 has moved the throttle valve 224 to the desired position and can make adjustments accordingly. The ECU 228 can also use the signal from the throttle valve position sensor 232 actively to control the ignition system 222 and the fuel injection system 220 along with other signals depending on the specific control scheme used by the ECU 228. The throttle valve position sensor 232 can be any suitable type of sensor such as a rheostat and a potentiometer as described above with respect to the throttle operator position sensor 230. Depending on the type of throttle valve actuator 226 being used, a separate throttle valve position sensor 232 may not be necessary. For example, a separate throttle valve position sensor 232 would not be required if the throttle valve actuator 226 is a servo motor since servo motors integrate their own feedback circuit that corrects the position of the motor and thus have an integrated throttle position sensor 232.

An engine speed sensor 234 senses a speed of rotation of the engine 22 and sends a signal representative of the speed of rotation of the engine 22 to the ECU 228. Typically, an engine, such as engine 22, has a toothed wheel disposed on and rotating with a shaft of the engine, such as the crankshaft or output shaft. The engine speed sensor 234 is located in proximity to the toothed wheel and sends a signal to the ECU 228 each time a tooth passes in front it. The ECU 228 can then determine the engine speed by calculating the time elapsed between each signal. The speed of rotation of the engine 22 can be used by the ECU 228 to calculate the engine torque.

A steering assembly position sensor 236 senses a turning of the steering assembly 238 and sends a signal representative of the orientation of the steering assembly 238 to the ECU 228. The steering assembly position sensor 236 can be in the form of a rheostat, a potentiometer, or magnetic switches which are activated when the steering assembly 238 is turned beyond a certain angle. Alternatively, the steering assembly position sensor 236 can be in the form of contact switches which are activated when the steering assembly 238 reaches a certain angle. The steering assembly position sensor 236 preferably senses a position of a steering column of the steering assembly 238. Alternatively, since the position of the steering nozzle 102 results from the position of the steering assembly 238, the position of the steering assembly 238 can be determined by having the steering assembly position sensor 236 sense a position of the steering nozzle 102.

A jet pump pressure sensor 240 senses a water pressure present in the jet pump 99 of the jet propulsion system 84. The jet pump pressure sensor 240 can be in the form of a pitot tube, but other types of pressure sensors are contemplated. The jet pump pressure sensor 240 sends a signal representative of the jet pump pressure to the ECU 228. The pressure in the jet pump 99 is representative of the amount of thrust being generated by the jet propulsion system 84.

Figure 22:
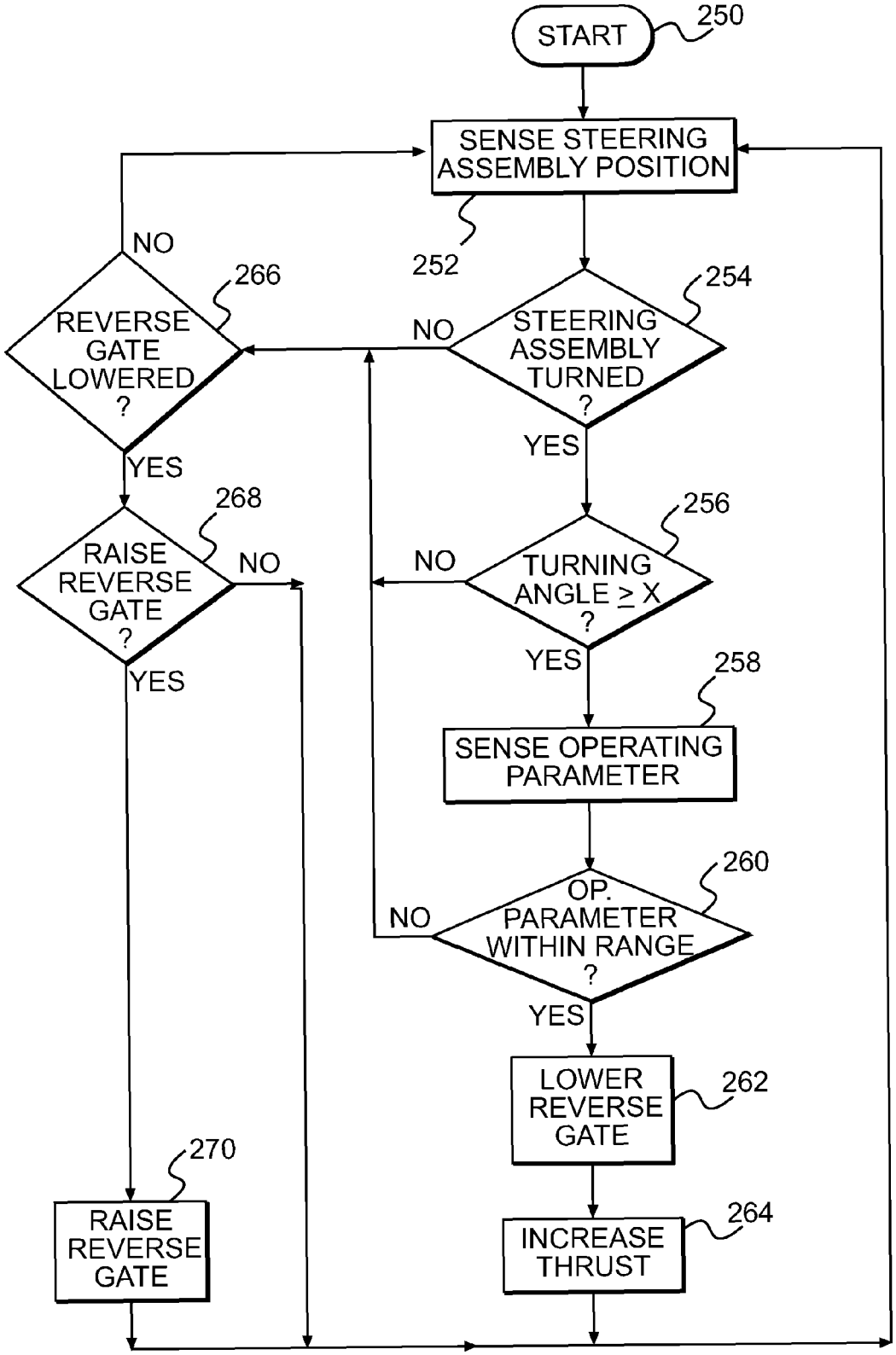
FIG. 22 is a logic diagram illustrating a method of operating a watercraft in accordance with the present invention.

Turning now to FIG. 22, a method of operating the watercraft 10 according to the present invention, beginning at step 250, will be described. The method is preferably carried out at least in part by the ECU 228, however it is contemplated that a separate dedicated control unit could be provided. At step 252, the steering assembly position sensor 236 senses a position of the steering assembly 238. Then, at step 254, the ECU 228 determines if the steering assembly 238 is turned. If the steering assembly 238 is not turned, then the ECU 228 moves to step 266 described in greater detail below. If the steering assembly 238 is turned, then at step 256, the ECU 238 determines if the angle by which the steering assembly 238 is turned, in either direction, is greater than or equal to a predetermined angle X. In a preferred embodiment, the angle X is between 20 to 30 degrees, but other angles are contemplated. If the steering assembly 238 is turned by less than the angle X, then the ECU 228 moves to step 266. If the angle by which the steering assembly 238 is turned is greater than or equal to the predetermined angle X, then the ECU moves to step 258.

At step 258, an operating parameter sensor senses an operating parameter of the watercraft 10 that is related to the thrust generated by the jet propulsion system 84. In the watercraft 10 described above, the operating parameter sensor can be any one of the engine speed sensor 234, the throttle operator position sensor 230, the throttle valve position sensor 232, the jet pump pressure sensor 240, and the vehicle speed sensor 106. However, it should be understood that other watercraft may be provided with other sensors that sense other operating parameters of the watercraft that are related to the thrust generated by the jet propulsion system, and such other sensors are contemplated. At step 260, the ECU 228 determines if the operating parameter that was sensed by the operating parameter sensor is within a predetermined range, which would indicate that the thrust being generated by the jet propulsions system 84 is insufficient to effectively steer the watercraft 10. It is contemplated that at step 260, the ECU 228 could determine a change in the value of the operating parameter being sensed over time based on historical data for that operating parameter being stored in memory, and then determine if this change is within a predetermined range. If at step 258 the operating parameter being sensed is the throttle operator position, then at step 260, the ECU 228 determines if the throttle operator position is less than a predetermined throttle operator position, since, as would be understood, the smaller the throttle operator position is, the less thrust is being generated by the jet propulsion system 84. If at step 258 the operating parameter being sensed is the throttle valve position, then at step 260, the ECU 228 determines if the throttle valve position is less than a predetermined throttle valve position, since, as would be understood, the smaller the throttle valve position is, the less thrust is being generated by the jet propulsion system 84. If at step 258 the operating parameter being sensed is the jet pump pressure, then at step 260, the ECU 228 determines if the jet pump pressure is less than a predetermined jet pump pressure, since, as would be understood, the jet pump pressure is directly related to the thrust being generated by the jet propulsion system 84. If at step 258 the operating parameter being sensed is the vehicle speed, then at step 260, the ECU 228 determines if the acceleration of the watercraft 10 (i.e. the change of watercraft speed over time) is a negative acceleration (i.e. a deceleration), since, as would be understood, a deceleration would be indicative of a reduction in thrust being generated by the jet propulsion system 84. If at step 260, the operating parameter sensed is not within the predetermined range, then the ECU 228 moves to step 266. If at step 260 the operating parameter sensed is within the predetermined range, then the ECU 228 moves to step 262.

Figure 23:
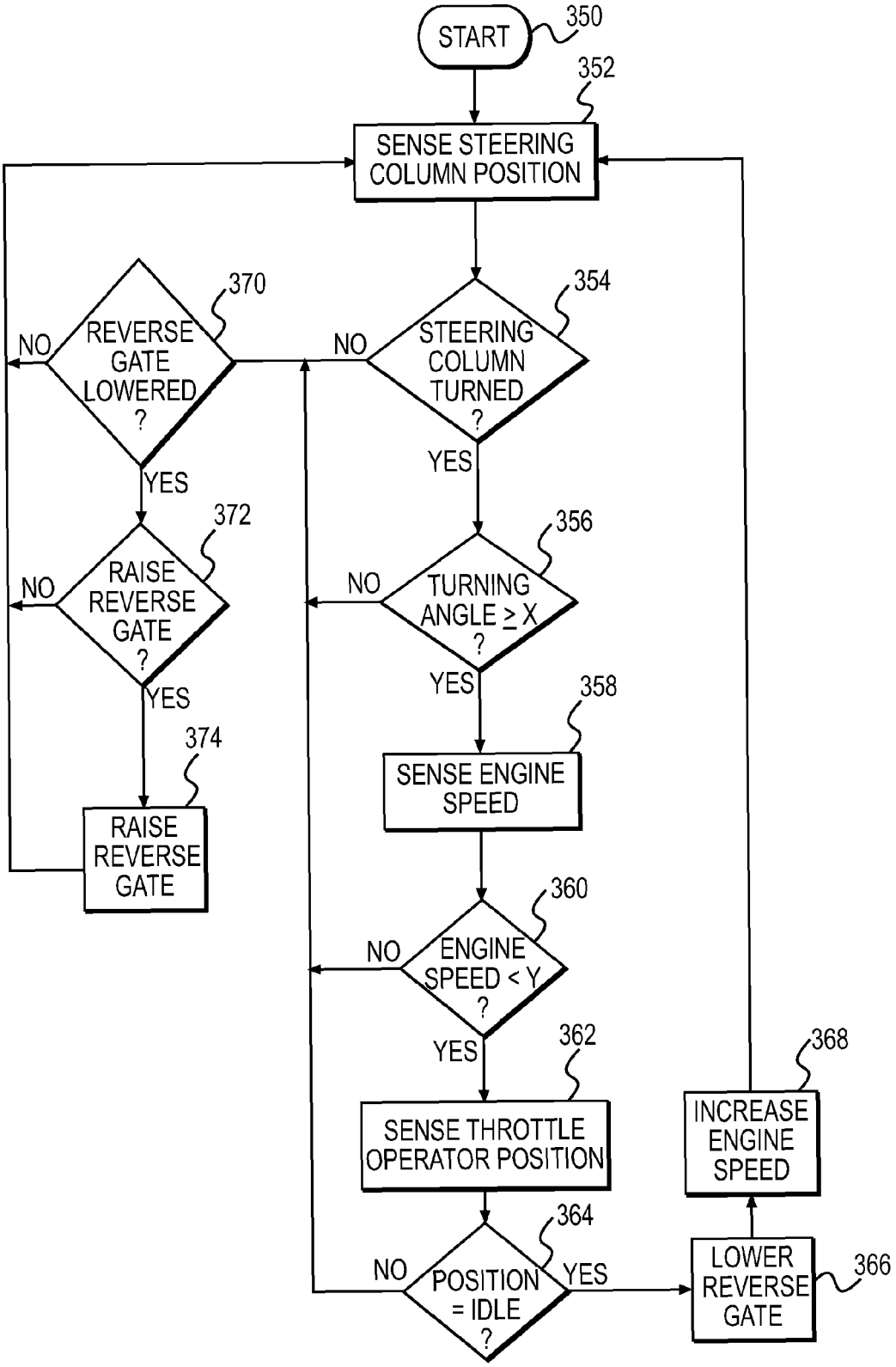
FIG. 23 is a logic diagram illustrating an embodiment of the method of FIG. 22.

It is contemplated that at steps 258 and 260 more than one operating parameter could be sensed and compared to a predetermined range. For example, at step 258 both the vehicle speed and the engine speed could be sensed. Then at step 260, if the vehicle speed is above a predetermined vehicle speed and the engine speed is below a predetermined engine speed, then the ECU 228 would move to step 262 from step 260. If either one of the two operating parameters is not within its predetermined range, then the ECU 228 would move to step 266 from step 260. FIG. 23, described in detail below, illustrates another embodiment where more than one operating parameter is used.

At step 262, the ECU 228 sends a signal to the reverse gate actuator 196 to move the reverse gate 110 to a lowered position. By lowering the reverse gate 110, the drag of the watercraft 10 in the water is increased, thus increasing the deceleration of the watercraft 10. It is contemplated that, following step 260, the thrust generated by the jet propulsion system 84 could be decreased prior to moving the reverse gate 110 to the lowered position, thus facilitating the lowering of the reverse gate at step 262. At step 264, once the reverse gate 110 is lowered, the thrust generated by the jet propulsion system 84 is increased, further increasing the deceleration of the watercraft 10. The thrust generated by the jet propulsion system 84 is sufficiently increased so as to allow the watercraft 10 to be steered. The thrust being generated by the jet propulsion system 84 is preferably increased by having the ECU 228 controlling one or more of the ignition system 222, the fuel injection system 220, and the throttle valve actuator 226 so as to increase the speed of the engine 22. It is contemplated that the ECU 228 could be provided with a dedicated set of engine control maps for controlling the engine 22 when the reverse gate is lowered in order to slow down and steer the watercraft 10. The dedicated control maps could, for example, be based on at least one of throttle operator position and a position of the steering assembly 238. It is also contemplated that the thrust being generated by the jet propulsion system 84 could be increased in intermittent bursts of thrust. Other ways of increasing the thrust being generated by the jet propulsion system 84 are also contemplated, such as, for example, by reducing the exit diameter of the venturi 100 or the steering nozzle 102.

Figure 24:
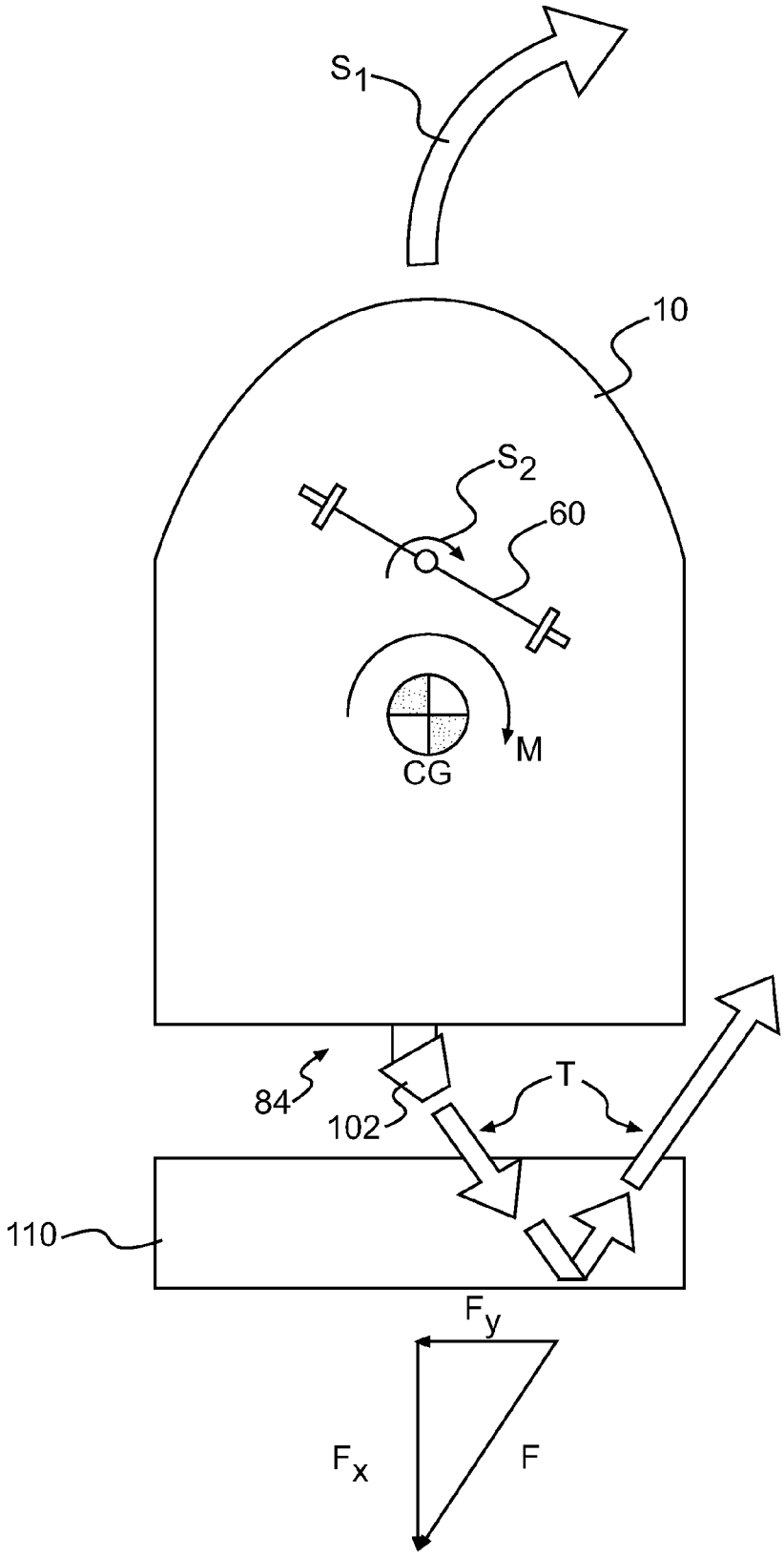
FIG. 24 is a schematic representation of forces and moments applied to the watercraft of FIG. 1 as a result of aspects of the present invention.

As can be seen in FIG. 24, for a watercraft 10 having a reverse gate 110 fixed about a vertical axis relative to the hull 12 (i.e. the reverse gate 110 does not turn left and right with the steering nozzle 102), when the reverse gate 110 is lowered, the thrust generated by the jet propulsion system 84 (indicated by arrows T) is redirected towards the front of the watercraft 10 such that a resulting force F is being applied to the watercraft 10. The force F has a component Fx which increases the deceleration of the watercraft 10 (while the watercraft 10 is still moving forward) and a component Fy which creates a moment M about the center of gravity CG of the watercraft 10. While the watercraft 10 is moving forward, the moment M causes the watercraft 10 to be steered in the direction S1 corresponding to the direction (indicated by arrow S2) in which the helm assembly 60 is turned. It should be noted that FIG. 24 is schematic and that the relative proportions of the components has been modified in order to facilitate understanding.

As would be understood by those skilled in the art, step 264 could be omitted on watercraft 10 having a reverse gate 110 that turns about a vertical axis with the steering nozzle 102 as this would result in the watercraft 10 being steered in a direction opposite the direction in which the helm assembly 60 is being turned. It is also contemplated that step 264 may be omitted, since the drag generated by the reverse gate 262 alone may be sufficient to decelerate the watercraft 10. It is contemplated that an additional step (not shown) could be provided after step 262, but before step 264 to determine if the thrust needs to be increased. If it is determined that, based on the operating parameters of the watercraft 10, the drag generated by the lowered reverse gate 262 alone is sufficient to decelerate the watercraft 10, then the ECU would return directly to step 252 from this additional step. If it is determined at this additional step that the thrust needs to be increase, then the ECU 228 moves to step 264.

From step 264, the ECU 228 returns to step 252 and the method is carried out once again.

If from step 254, 256, or 260, the ECU 228 has moved to step 266, the ECU 228 determines if the reverse gate 110 is lowered. This can be achieved by reading commands sent to the reverse gate actuator 196 that have been stored in memory, or by using a reverse gate position sensor (not shown). If at step 266 the reverse gate 110 is in a stowed position, the ECU 228 returns to step 252 and the method is carried out once again. However, if at step 266 the reverse gate 110 is lowered, then at step 268 the ECU 228 determines if the reverse gate 110 should be raised. If at step 268 the reverse gate 110 is lowered as a result of a manual command from the driver of the watercraft 10 to lower the reverse gate or as a result of something other than step 262 being previously carried out, then the reverse gate 110 is not raised and the ECU 228 returns to step 252 and the method is carried out once again. If at step 268 the reverse gate 110 is lowered as a result of step 262 being previously carried out, then the ECU 228 sends a signal to the reverse gate actuator 196 to move the reverse gate 110 to a stowed position at step 270. From step 270, the ECU 228 returns to step 252 and the method is carried out once again.

Turning now to FIG. 23, a specific embodiment of the method of operating a watercraft 10 of FIG. 22, starting at step 350, will be described. At step 352, the steering assembly position sensor 236 senses a position of the steering column of the steering assembly 238. Then, at step 354, the ECU 228 determines if the steering column is turned. If the steering column is not turned, then the ECU 228 moves to step 370 described in greater detail below. If the steering column is turned, then at step 356, the ECU 238 determines if the angle by which the steering column is turned, in either direction, is greater than or equal to a predetermined angle X. If the steering column is turned by less than the angle X, then the ECU 228 moves to step 370. If the angle by which the steering column is turned is greater than or equal to the predetermined angle X, then the ECU moves to step 358. It is contemplated that steps 354 and 356 could be combined in a single step.

At step 358, the engine speed sensor 234 senses the engine speed. At step 360, the ECU 228 determines if the engine speed is less than a predetermined engine speed Y, which would indicate that the thrust being generated by the jet propulsions system 84 is insufficient to effectively steer the watercraft 10. The predetermined engine speed Y is preferably between 2500 and 3500 RPM. It is contemplated however, that the value of Y may be outside that range as it depends on the type of watercraft and the type of jet propulsion system being used. If at step 360, the engine speed is not less than Y, then the ECU 228 moves to step 370. If at step 360 the engine speed is less than Y, then the ECU 228 moves to step 362.

At step 362, the throttle operator position sensor 230 senses the throttle operator position. At step 364, the ECU 228 determines if the throttle operator 76 is in the idle position, which would indicate that the driver of the watercraft 10 has let go of the throttle operator 76. If at step 364, the throttle operator 76 is not in the idle position, then the ECU 228 moves to step 370. If at step 364 the throttle operator 76 is in the idle position, then the ECU 228 moves to step 366.

At step 366, the ECU 228 sends a signal to the reverse gate actuator 196 to move the reverse gate 110 to a lowered position. At step 368, once the reverse gate 110 is lowered, the speed of the engine is increased by having the ECU 228 controlling one or more of the ignition system 222, the fuel injection system 220, and the throttle valve actuator 226 so as to increase the speed of the engine 22. It is contemplated that the ECU 228 could be provided with a dedicated set of engine control maps for controlling the speed of the engine 22 when the reverse gate is lowered in order to slow down and steer the watercraft 10. The dedicated control maps could, for example, be based on at least one of throttle operator position and a position of the steering assembly 238. It is also contemplated that the speed of the engine 22 could be increased in intermittent bursts. For the same reasons as those mentioned above with respect to step 264, it is contemplated that step 368 could be omitted. From step 368, the ECU 228 returns to step 352 and the method is carried out once again.

If from step 354, 356, 360, or 364, the ECU has 228 moved to step 370, the ECU 228 determines if the reverse gate 110 is lowered. If the reverse gate 110 is in a stowed position, the ECU 228 returns to step 352 and the method is carried out once again. If the reverse gate 110 is lowered, then at step 372 the ECU 228 determines if the reverse gate 110 should be raised. If the reverse gate 110 is lowered as a result of a manual command from the driver of the watercraft 10 to lower the reverse gate or as a result of something other than step 366 being carried out, then the reverse gate 110 is not raised and the ECU 228 returns to step 352 and the method is carried out once again. If the reverse gate 110 is lowered as a result of step 366 being carried out, then the ECU 228 sends a signal to the reverse gate actuator 196 to move the reverse gate 110 to a stowed position at step 374. From step 374, the ECU 228 returns to step 352 and the method is carried out once again.

In the above embodiments, it is contemplated that, when the reverse gate 110 is in a lowered position, the ECU 228 could use a first engine control map for controlling the engine 22 when the steering assembly 84 is steered in a straight ahead direction and a second engine control map for controlling the engine 22 when the steering assembly 84 is turned. In one example, the first and second maps are torque versus velocity maps, and for equivalent velocities, the second map results in less torque being applied by the engine 22 than for the first map.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A method of operating a watercraft, the watercraft including an engine, a jet propulsion system operatively connected to the engine, the jet propulsion system including a reverse gate, and a steering assembly for steering the watercraft, the method comprising:

determining if the steering assembly is turned;

sensing an operating parameter of the watercraft, the operating parameter being indicative of an amount of thrust generated by the propulsion system;

determining if the amount of thrust generated by the propulsion system is less than a predetermined amount of thrust by determining if the operating parameter of the watercraft is less than a predetermined value of the operating parameter;

automatically moving the reverse gate to a lowered position in response to both:

the steering assembly being turned, and the operating parameter of the watercraft being less than the predetermined value of the operating parameter; and increasing a thrust produced by the jet propulsion system in order to control directional movement of the watercraft when:

the reverse gate is moved to the lowered position, the steering assembly is turned, and the operating parameter of the watercraft is less than the predetermined value of the operating parameter, the reverse gate in the lowered position redirecting the thrust produced by the jet propulsion system toward a front of the watercraft.

2. The method of claim 1, wherein increasing the thrust produced by the jet propulsion system includes increasing a speed of the engine.

3. The method of claim 1, wherein the operating parameter is engine speed; and wherein the predetermined value of the operating parameter is a predetermined engine speed.

4. The method of claim 3, further comprising determining if a throttle operator of the watercraft is in an idle position; and wherein the reverse gate is moved to the lowered position in response to:

the steering assembly being turned, the engine speed being less than the predetermined engine speed, and the throttle operator being in the idle position.

5. The method of claim 1, wherein the operating parameter is a throttle operator position; and wherein the predetermined value of the operating parameter is a predetermined throttle operator position.

6. The method of claim 1, wherein the operating parameter is a throttle valve position; and wherein the predetermined value of the operating parameter is a predetermined throttle valve position.

7. The method of claim 1, wherein the operating parameter is a jet pump pressure of the jet propulsion system; and wherein the predetermined value of the operating parameter is a predetermined jet pump pressure.

8. The method of claim 1, wherein the operating parameter is an acceleration of the watercraft; and wherein the predetermined value of the operating parameter is a predetermined acceleration.

9. The method of claim 1, wherein determining if the steering assembly is turned includes determining if a steering column of the steering assembly has been turned by at least a predetermined angle.

10. The method of claim 1, wherein determining if the steering assembly is turned includes determining if a steering nozzle of the jet propulsion system has been turned by at least a predetermined angle.

11. A watercraft comprising:

a hull;

a deck disposed on the hull;

an engine compartment defined between the hull and the deck;

an engine disposed in the engine compartment;

an engine control unit operatively connected to the engine;

a throttle body having a throttle valve operatively connected to the engine;

a throttle operator operatively connected to the throttle valve;

a steering assembly disposed at least in part on the deck;

a jet pump connected to the hull and being operatively connected to the engine;

a venturi connected to a rearward end of the jet pump;

a steering nozzle rotationally mounted relative to the venturi, the steering nozzle being operatively connected to the steering assembly and being disposed at least in part rearwardly of the venturi;

a reverse gate rotationally mounted relative to the venturi about a reverse gate axis, the reverse gate axis extending generally laterally and horizontally;

a steering assembly position sensor operatively connected to the steering assembly, the steering assembly position sensor sensing a position of the steering assembly;

an operating parameter sensor operatively connected to one of the engine, the throttle valve, and the throttle operator, the operating parameter sensor sensing an operating parameter of the one of the engine, the throttle valve, and the throttle operator, the operating parameter being indicative of an amount of thrust generated by the jet pump; and a reverse gate actuator operatively connected to the reverse gate, the reverse gate actuator automatically moving the reverse gate to a lowered position in response to both:

the steering assembly position sensor sensing that the steering assembly has been turned by at least a predetermined angle, and the operating parameter sensor sensing that the operating parameter is less than a predetermined value of the operating parameter, thereby indicating that the amount of thrust generated by the jet pump is less than a predetermined amount of thrust, the engine control unit causing a speed of the engine to be increased in order to control directional movement of the watercraft in response to:

the reverse gate being in the lowered position, the steering assembly position sensor sensing that the steering assembly has been turned by at least the predetermined angle, and the operating parameter sensor sensing that the operating parameter is less than the predetermined value of the operating parameter, the reverse gate in the lowered position redirecting thrust produced by the jet pump toward a front of the watercraft.

12. The watercraft of claim 11, wherein the operating parameter sensor senses engine speed; and wherein the predetermined value of the operating parameter is a predetermined engine speed.

13. The watercraft of claim 12, further comprising a throttle operator position sensor operatively connected to the throttle operator, the throttle operator position sensor sensing a position of the throttle operator; and wherein the reverse gate actuator moves the reverse gate to the lowered position in response to:

the steering assembly position sensor sensing that the steering assembly has been turned by at least the predetermined angle, the operating parameter sensor sensing that the operating parameter is less than the predetermined value of the operating parameter, and the throttle operator position sensor sensing that the throttle operator is in an idle position.

14. The watercraft of claim 11, wherein the operating parameter sensor senses a throttle operator position; and wherein the predetermined value of the operating parameter is a predetermined throttle operator position.

15. The watercraft of claim 11, wherein the operating parameter sensor senses a throttle valve position; and wherein the predetermined value of the operating parameter is a predetermined throttle valve position.

16. The watercraft of claim 11, wherein the steering assembly position sensor senses a position of a steering column of the steering assembly.

17. The watercraft of claim 11, wherein the steering assembly position sensor senses a position of the steering nozzle.

* * * * *